US010718506B2

(12) United States Patent
Adams et al.

(10) Patent No.: US 10,718,506 B2
(45) Date of Patent: Jul. 21, 2020

(54) LUMINAIRE WITH ADAPTER COLLAR

(71) Applicant: ABL IP Holding LLC, Atlanta, GA (US)

(72) Inventors: Vincent Adams, Snellville, GA (US); Brent James Smith, McDonough, GA (US); Luke Jonathon Siefker, McDonough, GA (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 16/368,235

(22) Filed: Mar. 28, 2019

(65) Prior Publication Data

US 2019/0301711 A1 Oct. 3, 2019

Related U.S. Application Data

(60) Provisional application No. 62/650,366, filed on Mar. 30, 2018.

(51) Int. Cl.

| | |
|---|---|
| ***F21V 29/83*** | (2015.01) |
| ***F21V 29/60*** | (2015.01) |
| ***F21V 3/04*** | (2018.01) |
| ***F21V 17/00*** | (2006.01) |
| ***F21V 3/00*** | (2015.01) |
| ***F21V 15/01*** | (2006.01) |
| ***F21V 23/00*** | (2015.01) |

(Continued)

(52) U.S. Cl.

CPC ..... *F21V 29/83* (2015.01); *F21V 3/00* (2013.01); *F21V 3/04* (2013.01); *F21V 15/01* (2013.01); *F21V 17/002* (2013.01); *F21V 23/003* (2013.01); *F21V 29/60* (2015.01); *H01Q 1/44* (2013.01); *H05B 47/19* (2020.01); *F21Y 2115/10* (2016.08)

(58) Field of Classification Search

CPC ..... F21V 29/83; F21V 15/01; F21V 17/002

See application file for complete search history.

(56) References Cited

U.S. PATENT DOCUMENTS

| | | | |
|---|---|---|---|
| 1,604,773 | A | 10/1926 | Gillinder |
| 1,755,836 | A | 4/1930 | Petrillo |

(Continued)

FOREIGN PATENT DOCUMENTS

| | | |
|---|---|---|
| JP | 2010135181 | 6/2010 |
| WO | 2016128496 | 8/2016 |

OTHER PUBLICATIONS

U.S. Appl. No. 29/642,542, "Notice of Allowance," dated Aug. 14, 2019, 7 pages.

(Continued)

*Primary Examiner* — Donald L Raleigh

(74) *Attorney, Agent, or Firm* — Kilpatrick Townsend & Stockton LLP

(57) ABSTRACT

A luminaire includes a housing assembly, a spacer, and a globe optic. A collar may be included on the spacer such that the luminaire can accommodate different sizes of globe optics without requiring complete replacement of the luminaire. The spacer may include airflow apertures that promote air circulation within the luminaire when the luminaire is assembled. A wireless node may be included with the luminaire. In some examples, the wireless node may be positioned on at least one of the housing assembly, the spacer, or the globe optic.

18 Claims, 16 Drawing Sheets

(51) Int. Cl.

| | |
|---|---|
| ***H01Q 1/44*** | (2006.01) |
| ***H05B 47/19*** | (2020.01) |
| *F21Y 115/10* | (2016.01) |

(56) References Cited

U.S. PATENT DOCUMENTS

| | | | | |
|---|---|---|---|---|
| 1,789,342 | A | 1/1931 | Petrillo | |
| 1,871,847 | A | 8/1932 | Green et al. | |
| 1,888,836 | A | 11/1932 | Rowe | |
| 1,889,720 | A | 11/1932 | Willman | |
| 1,947,806 | A | 2/1934 | Smith | |
| 2,102,922 | A | 12/1937 | Schwab | |
| 3,679,891 | A | 7/1972 | Quack | |
| 3,747,883 | A | 7/1973 | Inman | |
| D232,499 | S | 8/1974 | Martinelli | |
| 5,134,554 | A | 7/1992 | Donato et al. | |
| 5,243,508 | A | 9/1993 | Ewing et al. | |
| 5,282,118 | A | 1/1994 | Lee | |
| 5,442,532 | A | 8/1995 | Boulos et al. | |
| 5,590,953 | A | 1/1997 | Haslam et al. | |
| 5,626,417 | A | 5/1997 | McCavit | |
| 5,814,945 | A | 9/1998 | Hsu | |
| 5,857,769 | A | 1/1999 | Beggs | |
| 6,337,792 | B1 | 1/2002 | George | |
| D560,025 | S | 1/2008 | Shulem | |
| D566,977 | S | 4/2008 | Emge | |
| D566,978 | S | 4/2008 | Gonzalez | |
| D570,125 | S | 6/2008 | Gonzalez | |
| 7,434,964 | B1 | 10/2008 | Zheng et al. | |
| D586,574 | S | 2/2009 | Gomree | |
| 7,513,653 | B1 | 4/2009 | Liu et al. | |
| 7,611,265 | B2 * | 11/2009 | Laporte | F21S 8/081 362/267 |
| 7,946,734 | B2 | 5/2011 | Laporte | |
| D640,878 | S | 7/2011 | Huang et al. | |
| D642,329 | S | 7/2011 | Weiss | |
| 8,013,347 | B2 | 9/2011 | Zhang et al. | |
| D648,868 | S | 11/2011 | Chou | |
| 8,092,032 | B2 | 1/2012 | Pearse | |
| D666,012 | S | 8/2012 | Walker et al. | |
| 8,262,258 | B2 | 9/2012 | Vandersluis et al. | |
| 8,596,821 | B2 | 12/2013 | Brandes et al. | |
| 8,608,352 | B2 | 12/2013 | Tsai | |
| 8,777,453 | B2 | 7/2014 | Donegan | |
| D732,238 | S | 6/2015 | Kling et al. | |
| D744,125 | S | 11/2015 | Cai | |
| 9,310,065 | B2 | 4/2016 | Hussell et al. | |
| D758,633 | S | 6/2016 | Sooferian | |
| 9,360,202 | B2 | 6/2016 | Maxik et al. | |
| 9,410,687 | B2 | 8/2016 | Hussell et al. | |
| 9,625,105 | B2 | 4/2017 | Tong et al. | |
| 9,664,370 | B2 | 5/2017 | Van Der Merwe et al. | |
| 9,726,359 | B1 | 8/2017 | Jensen et al. | |
| 9,765,956 | B2 | 9/2017 | Kovalchick et al. | |
| 9,787,885 | B2 | 10/2017 | Chien | |
| 9,903,576 | B2 | 2/2018 | Creasman et al. | |
| 9,949,348 | B2 | 4/2018 | Alexander | |
| D819,260 | S | 5/2018 | Nankil | |
| D825,789 | S | 8/2018 | Creasman et al. | |
| D830,585 | S | 10/2018 | Grandadam | |
| D832,493 | S | 10/2018 | Murphy et al. | |
| D869,746 | S | 12/2019 | Adams et al. | |
| 2003/0161149 | A1 | 8/2003 | Eaton, Jr. | |
| 2007/0177384 | A1 | 8/2007 | Sibalich et al. | |
| 2010/0033071 | A1 | 2/2010 | Heffington et al. | |
| 2010/0091486 | A1 | 4/2010 | Wu | |
| 2010/0265710 | A1 | 10/2010 | Xiao et al. | |
| 2011/0050100 | A1 | 3/2011 | Bailey et al. | |
| 2011/0080097 | A1 * | 4/2011 | Morrow | B64F 1/20 315/116 |
| 2011/0095687 | A1 | 4/2011 | Jonsson | |
| 2013/0033881 | A1 | 2/2013 | Terazawa et al. | |
| 2014/0293603 | A1 | 10/2014 | Barnard et al. | |
| 2014/0340870 | A1 | 11/2014 | Premysler | |
| 2014/0375202 | A1 | 12/2014 | Yang et al. | |
| 2015/0077997 | A1 | 3/2015 | Sun | |
| 2015/0176830 | A1 | 6/2015 | Liang | |
| 2015/0276192 | A1 | 10/2015 | Kafry et al. | |
| 2016/0135270 | A1 | 5/2016 | Earl et al. | |
| 2016/0146438 | A1 | 5/2016 | LaFemina | |
| 2016/0341370 | A1 | 11/2016 | Dekker et al. | |
| 2018/0249563 | A1 * | 8/2018 | Alexander | H05B 37/0272 |
| 2019/0041030 | A1 * | 2/2019 | Dahlen | F21V 7/0016 |

OTHER PUBLICATIONS

U.S. Appl. No. 16/368,252, "Non-Final Office Action," dated Feb. 21, 2020, 16 pages.

* cited by examiner

LUMINAIRE WITH ADAPTER COLLAR

REFERENCE TO RELATED APPLICATION

This application claims the benefit of U.S. Provisional Application No. 62/650,366, filed Mar. 30, 2018 and entitled LUMINAIRE, the content of which is hereby incorporated by reference in its entirety.

FIELD OF THE INVENTION

Embodiments of the invention relate to an improved luminaire that can be, but that does not have to be, mounted on a pole to create a post top fixture.

BACKGROUND

Luminaires for providing general illumination to an area are well known and often used in outdoor lighting applications, including roadway, pedestrian, and residential area lighting. Such luminaires can be mounted atop a pole and typically include light sources (such as light emitting diodes ("LEDs")), a housing, and a light transmissive globe mounted atop the housing that permits light generated by the light sources to exit the luminaire and provide the desired illumination. Such luminaires are typically completely enclosed, thereby rendering it difficult to thermally dissipate the heat generated by the light sources. Moreover, housing historically have been sized to accommodate a globe having a base transverse dimension, such as a diameter, of a specific size or range. The housings have not been capable of universally accommodating globes of differing base transverse dimensions.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim According to certain embodiments of the present disclosure, a collar for a luminaire is positionable on a spacer of the luminaire. The spacer includes a first transverse dimension, and the collar includes a second transverse dimension that is different from the first transverse dimension. A globe of the luminaire may be positioned on the collar, or the collar may be removed from the luminaire, and a globe of the luminaire may be positioned on the spacer.

According to some embodiments of the present disclosure, a luminaire may include a wireless node. The wireless node includes a wireless module and an antenna associated with the wireless module. In various examples, the wireless module may be positioned within a housing chamber of a housing of the luminaire or within a globe chamber of a globe of the luminaire. The antenna may be positioned within the housing chamber, within the globe chamber, or outside of the globe chamber.

According to various embodiments of the present disclosure, a spacer for a luminaire includes a spacer rim and a spacer body. The spacer body defines a central passageway extending through the spacer body such that the spacer is hollow along a length of the spacer. The spacer body also defines a plurality of airflow apertures in fluid communication with the central passageway such that air can circulate through the spacer.

Various implementations described in the present disclosure can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Directional references such as "up," "down," "top," "left," "right," "front," and "back," among others are intended to refer to the orientation as illustrated and described in the figure (or figures) to which the components and directions are referencing.

Embodiments of the present invention are directed to luminaires that generally include a housing, a spacer, and a globe optic atop the housing. The housing may be mounted atop a pole, and light emitted by light sources located within the luminaire passes through the globe to emit light into the environment. While embodiments of the luminaire are disclosed for mounting atop a pole, such embodiments are not limited to such use but rather can be installed in different environments (i.e., indoor, outdoor) and in different manners. Moreover, while LEDs are described, it will be recognized that the invention may be embodied in light fixtures using other kinds of light sources, for example fluorescent, incandescent, halogen, etc.

As used herein, a "transverse dimension" refers to the dimension across the widest portion of the component. It will be appreciated that the transverse dimension may depend on a shape of the component. A diameter of an object is an example of a transverse dimension. As such, while the description below references diameters, it will be appreciated that the shape of the luminaires and components of the luminaires is not considered limiting on the current disclosure.

Luminaire

FIGS. 1-18 illustrate an example of a luminaire 100. The luminaire 100 generally includes a housing assembly 102, a spacer 104, and a globe 106 (i.e., optic). In some examples, the housing assembly 102 may be mounted atop a pole (not shown), and light emitted by light sources located within the luminaire 100 passes through the globe 106 to emit light into the environment. In some cases, the pole may be a metallic pole; however, in other examples, the pole may be non-metallic (e.g., fiberglass, concrete, etc.). In other examples, the luminaire 100 may be installed in various other environments and in various other manners as desired.

Figure 8:
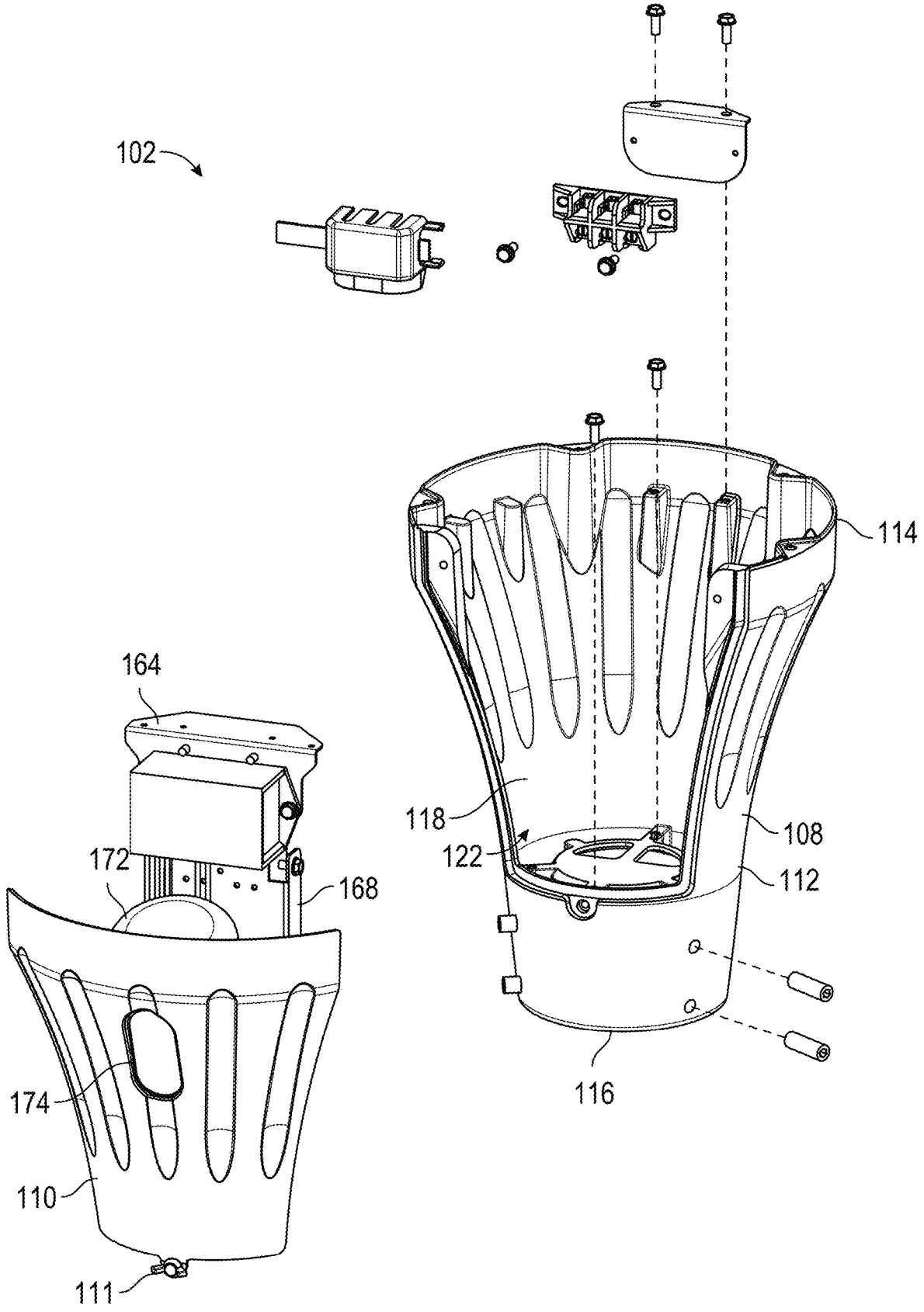
FIG. 8 is an exploded assembly view of the housing assembly of FIG. 1.

The housing assembly 102 includes a housing 108. As best illustrated in FIG. 8, the housing 108 includes a sidewall 112 having a first end 114 and a second end 116. The sidewall 112 defines a housing chamber 118 that houses the electronic components for powering the luminaire 100. Electrical connections between the main power coming up through the pole and a driver 120 and between the driver 120 and light sources of the luminaire 100 can be made in the housing 108. In some examples, the sidewall 112 defines an opening 122 that provides access through the sidewall 112 and into the housing chamber 118. In such examples, the housing assembly 102 may include a removable housing door 110 that selectively provides or restricts access to the housing chamber 118 through the opening 122. The removable housing door 110 may be selectively attached to the housing 108 through various suitable mechanisms. In the present example, a wing screw 111 is utilized to secure the housing door 110 to the housing 108.

Figure 13:
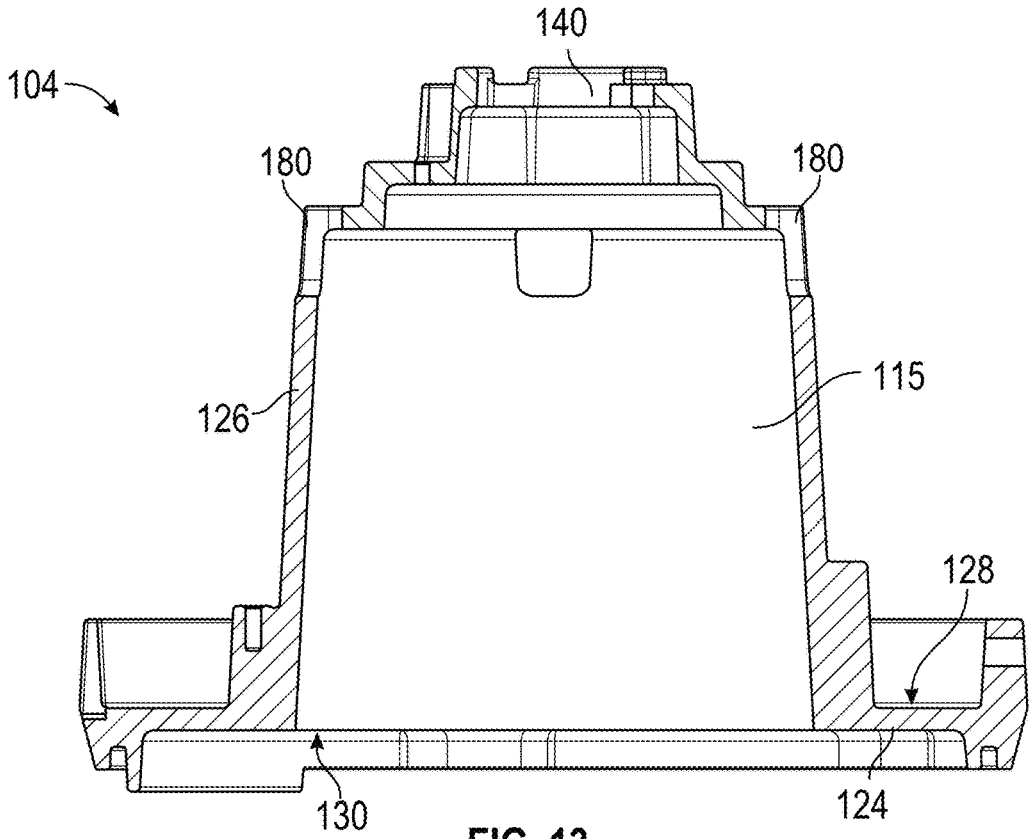
FIG. 13 is a sectional view of the spacer of FIG. 12.

The spacer 104 is positioned on the first end 114 of the housing 108 when the luminaire 100 is assembled. As best illustrated in FIG. 13, the spacer 104 is hollow and defines a central passageway 115 such that wires can extend through the spacer 104 between the light source(s) of the luminaire and the housing assembly 102.

The spacer 104 includes a spacer rim 124 and a spacer body 126. The spacer rim 124 includes a rim surface 128, and the spacer body 126 extends upwardly relative to the spacer rim 124 and the rim surface 128. The spacer rim 124 also includes a mounting surface 130 that is opposite from the rim surface 128 (see FIGS. 13 and 14). In some optional examples, the mounting surface 130 defines a groove 132, and a gasket 134 (see FIG. 7) or other suitable sealing device or thermal interface material (TIM) is positioned within the groove 132. In various examples, when assembled, the first end 114 of the housing 108 is positioned within the groove 132 and a seal is formed between the housing 108 and the spacer 104 with the gasket 134. Screws 136 may extend through the spacer 104 and into bosses in the housing 108 to tighten and seal the spacer 104 onto the housing 108; however, other suitable retention means and methods for securing the spacer 104 to the housing 108 may also be utilized.

Figure 15:
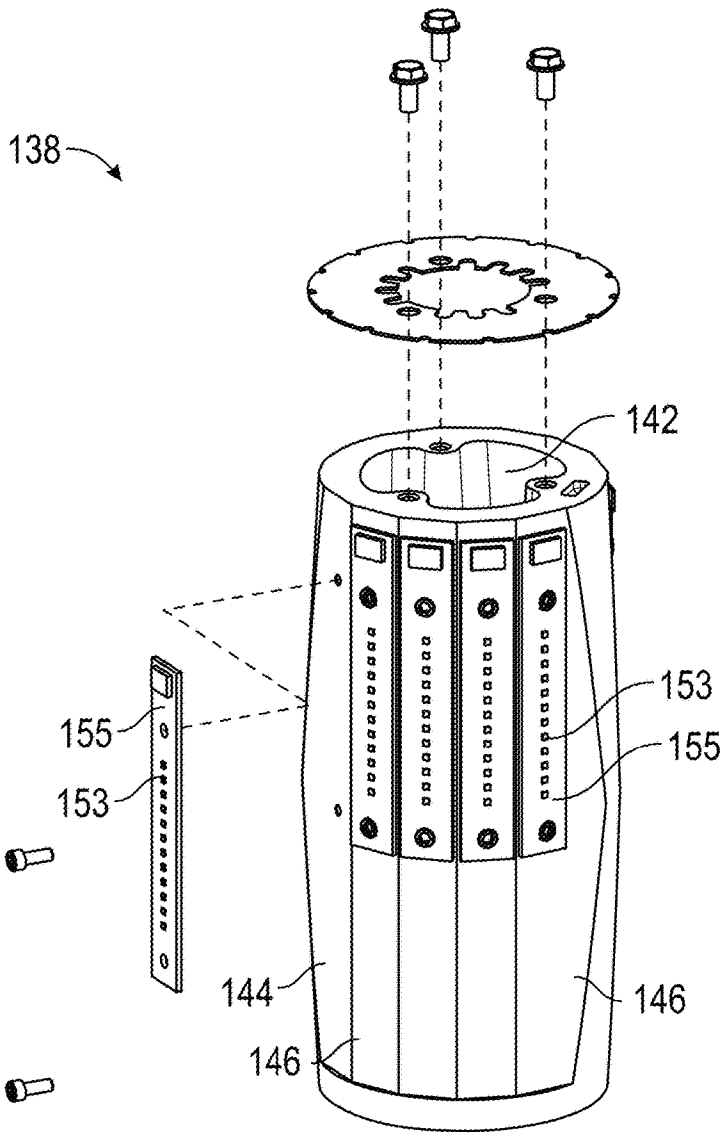
FIG. 15 is a partially exploded assembly view of the light engine stalk of FIG. 3.
Figure 14:
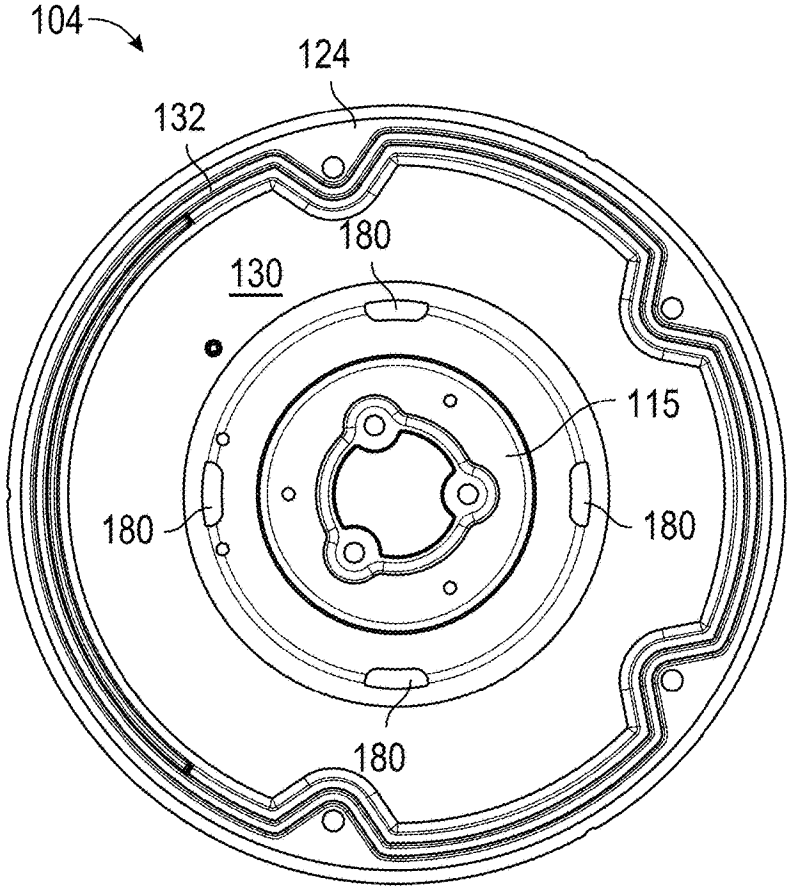
FIG. 14 is a bottom plan view of the spacer of FIG. 12.
Figure 16:
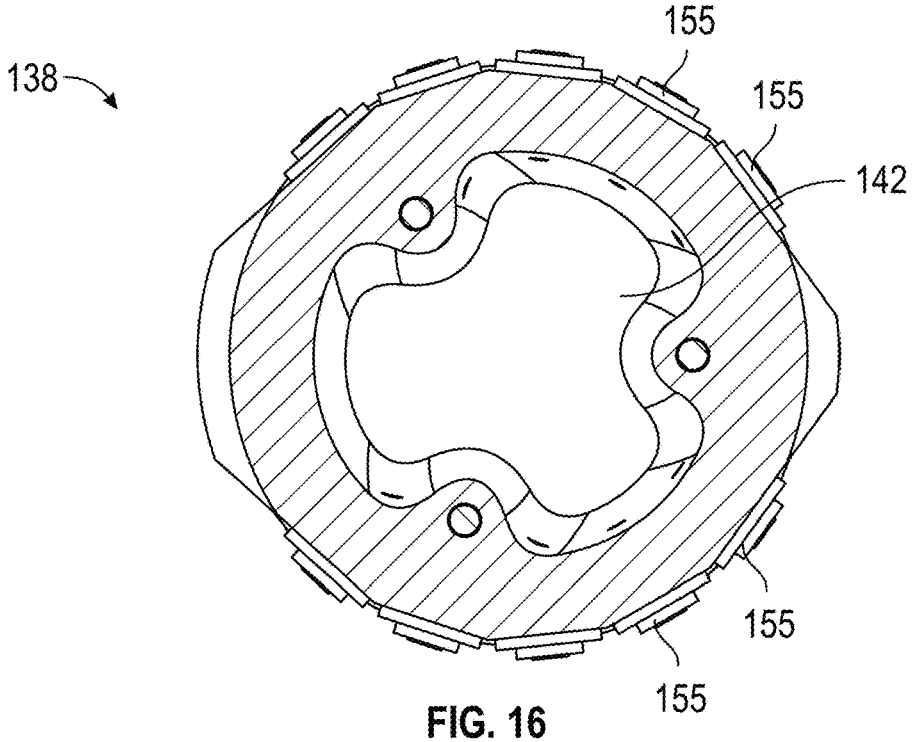
FIG. 16 is a sectional view of the light engine stalk of FIG. 15.

In various examples, the luminaire 100 includes a light engine stalk 138 that supports one or more light sources for the luminaire (see FIGS. 5-7, 15, and 16). As best illustrated in FIG. 15, the stalk 138 includes an outer surface 144 that defines a number of mounting location 146 for the light sources. The stalk 138 may be hollow and include a central passageway 142. In various cases, a cross-sectional shape of the stalk 138 and/or the central passageway 142 may have various shapes or configurations as desired, including, but not limited to, round, polygonal, rectilinear, elliptical, or various other suitable shapes.

Light sources such as light emitting diodes ("LEDs") 153 may be supported on the stalk 138. While LEDs are described, it will be recognized that the invention may be embodied in light fixtures using other kinds of light sources, for example fluorescent, incandescent, halogen, etc. The LEDs 153 may be positioned on the outer surface 144 of the stalk 138. When LEDs are utilized, the LEDs may be various types of LEDs including single-die LEDs, multi-die LEDs, direct current (DC) LEDs, alternating current (AC) LEDs, organic light emitting diodes, and/or various other suitable LEDs. White, color, or multicolor LEDs, or combinations thereof, may be used. Moreover, the LEDs need not all be the same color and/or type; rather, mixtures of different colors and/or types of LEDs may be used. The LEDs may be provided on one or more printed circuit boards (PCBs) 155. However, in other embodiments, no PCB is needed; rather, the LEDs may be chip-on-board LEDs provided directly on the outer surface 144 of the stalk 138. In further examples, any number of PCBs may be utilized, including more than one PCB. In some cases, the LEDs 153 may be provided in various configurations on the stalk 138 depending on a desired optical distribution. For example, the LEDs 153 may be provided uniformly around and along the outer surface 144, in various groupings of LEDs 153 on the outer surface 144, asymmetrically provided around and along the outer surface 144. In some examples, different stalks with different PCB or LED layouts may be used to achieve different optical distributions. FIG. 19 illustrates an example of another luminaire 1900 with a stalk 1938 having a different arrangement of light sources and a different profile compared to that of FIGS. 1-18. Alternatively, a single universal stalk may be used to achieve different distributions (see, e.g., U.S. Patent No. 2009/0262530, incorporated herein by reference).

When the luminaire 100 is assembled, the light engine stalk 138 is positioned on top of the spacer 104. In some examples, one or more alignment features 140 extend from the top of the spacer body 126. The alignment features 140 may be sized and shaped to mate with the central passageway 142 or one or more apertures on the stalk 138 to secure and align the stalk 138 on the spacer 104. Screws or other suitable attachment mechanisms may securely retain the stalk 138 on the spacer 104. In some examples, a gasket 148 or suitable thermal interface material may be provided between the stalk 138 and the spacer 104 to improve thermal transfer.

The housing assembly 102, spacer 104, and stalk 138 may be formed from a material having suitable thermal management capabilities so as to conduct heat generated by the fixture during use. Metallic materials (e.g., aluminum) may be particularly suitable; however, thermally conductive plastics (e.g., CoolPoly® from Celanese) may also be used. In other examples, the housing assembly 102, spacer 104, and stalk 138 need not be formed from the same material. Fins or other heat dissipating structures may be provided on one or more of these structures to further enhance heat transfer. The housing assembly 102, spacer 104, and/or stalk 138 may be formed using a variety of different technologies, including, but not limited to, die-forming, casting, extruded, etc.

The globe 106 is mounted atop the spacer 104. The globe 106 can be made from any suitable translucent material that permits the passage of light (e.g., glass, acrylic, polycarbonate, silicone, etc.) and is optionally imparted with optical enhancements (e.g., ribbing, prisms, frosted appearance, etc.) to achieve the desired light distribution and effect from the luminaire. In some embodiments, the globe 106 is molded from a polymeric material (e.g., polycarbonate).

The globe 106 includes a light-emitting portion 150 and a base 152 (see FIG. 7), and the light-emitting portion 150 defines a globe chamber. In various examples, the spacer rim 124 of the spacer 104 has an outer diameter that is larger than the outer diameter of the base 152. Thus, the base 152 of the globe 106 can seat within the spacer rim 124, optionally on the rim surface 128. Screws 154 or other suitable retaining mechanisms may secure and position the globe 106 relative to the spacer 104. In some examples, the screws 154 are positioned through the spacer rim 124 and turned so as to bear against the base 152 of the globe 106. In other embodiments, a flange 156 is provided around the base 152 of the globe 106. In such embodiments, when inserted, the screws 154 bear against the top of the flange 156 and force the globe 106 downwardly toward the spacer 104 and retain it in place. A gasket 158 or other suitable device may be interposed between the spacer 104 and the globe 106 to create an airtight environment within the luminaire 100.

Once the globe 106 is retained on the spacer 104, the luminaire 100 becomes fully enclosed. In various aspects, the stalk 138 and at least a portion of the spacer 104 are positioned within the globe chamber. In use, heat generated by the electronic components and the LEDs 153 dissipates to the air in the luminaire 100. The air can rise up from the housing assembly 102, through the spacer 104 and stalk 138, and exit the top of the stalk 138. The air then moves along a downward path along the outside of the stalk 138 and spacer 104, carrying heat with it as it goes.

Embodiments of the luminaire 100 may also include additional optical features to control the directionality or appearance of light emitted from the luminaire 100. By way only of example, a reflective shield 160 may be provided within the luminaire 100 to create an asymmetrical distribution of light from the luminaire 100 or to act as a light trespass shield (see FIGS. 3 and 5-7). The reflective shield 160 may have various suitable shapes or profiles as desired. Alternatively or in addition, an internal refractor 162 (which can be, but does not have to be, glass) may be provided around the stalk 138 to control the optical distribution and/or to reduce glare (see FIGS. 6 and 7). Various other features or combinations of features may be utilized with the luminaire 100 to control the directionality or appearance of light emitted from the luminaire 100.

Housing Door

As mentioned, in some examples, the housing assembly 102 optionally includes the housing door 110. As best illustrated in FIGS. 8-11, in various examples, the housing door 110 includes an electrical tray 164 that can support one or more electronic components. Any electrical components on the electrical tray 164 may be easily accessible for installation, replacement, or repair when the housing door 110 is removed.

The electrical tray 164 includes an extension arm 166 that extends from an inner surface of the housing door 110 (when the electrical tray 164 is mounted on the door 110) and a mounting arm 168 that extends upwardly at an angle from the extension arm 166. In some cases, the angle between the extension arm 166 and the mounting arm 168 is greater than 90°, although it need not be. In other examples, the angle can be other angles (including acute and obtuse angles). One or more drivers 120 for driving the LEDs 153 may be mounted on a first surface of mounting arm 168. A support ledge 170 extends from an opposing, second surface of the mounting arm 168. The support ledge 170 is configured to support a standard or wireless node 172 within the housing chamber 118, although various other electrical components may be supported on the mounting arm 168 and/or support ledge 170. When positioned on the support ledge 170, the wireless node 172 is located within the space formed between the housing door 110 and the mounting arm 168.

Optionally, the electrical tray 164 may extend at least partially into the central passageway 115 of the spacer 104 when the luminaire is assembled. In such examples, electrical components (e.g., the wireless node 172) may extend at least partially into the spacer 104. Such positioning may improve line of sight and signal strength of the wireless node 172.

In some optional examples, the housing door 110 defines a window 174. The window 174 may be proximate to the electrical tray 164 to provide line of sight between electrical components within the housing 108 and devices or components outside of the luminaire 100. In some examples, the wireless node 172 is provided proximate to the window 174 to ensure line of sight. The window 174 may be elongated and/or have various other shapes or configurations as desired to support different z heights of standard and wireless nodes. In various aspects, the window 174 has a non-round profile, although it need not in other examples. In other words, the window 174 may be various suitable shapes as desired.

Wireless Node

The luminaire 100 may include the wireless node 172, which may be any type of wireless communication device, including, but not limited to, a radio frequency node, a Bluetooth® node, a photosensor (for detecting visible light or infrared light), a radar module, a lidar module, a microwave sensor module, and/or a node that is part of a networked communication lighting system, such as the ROAM system available from Acuity Brands Lighting (https://www.acuitybrands.com/products/controls/roam) or the SELC system available from Silver Springs Network (now Itron) (www.silverspringnet.com/partner/selc). With the wireless node 172, the luminaire 100 may communicate with other external devices such as other luminaires, user devices, etc.

The wireless node 172 generally includes a module 176 and an antenna 178 associated with the module 176. The module 176 includes controlling, electronics for the wireless node 172. In some cases, the module 176 may be connected to the antenna 178 through wiring or cabling such that the module 176 and antenna 178 may be positioned at different locations on the luminaire as desired. In other examples, the antenna 178 may be an onboard antenna on the module 176 in that the antenna 178 is mounted on the module 176.

Figure 9:
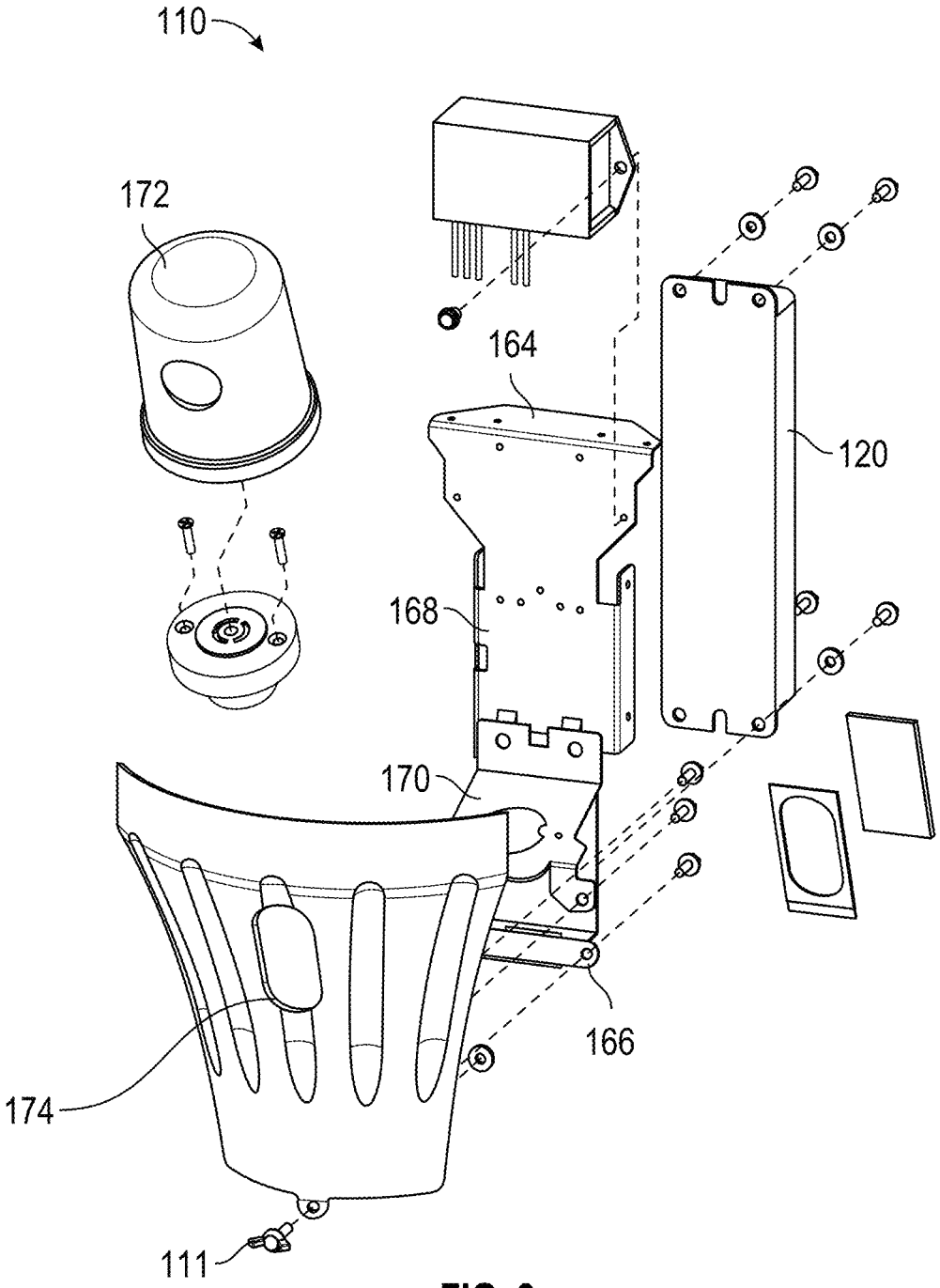
FIG. 9 is an exploded assembly view of a housing door of the housing assembly of FIG. 8.
Figure 10:
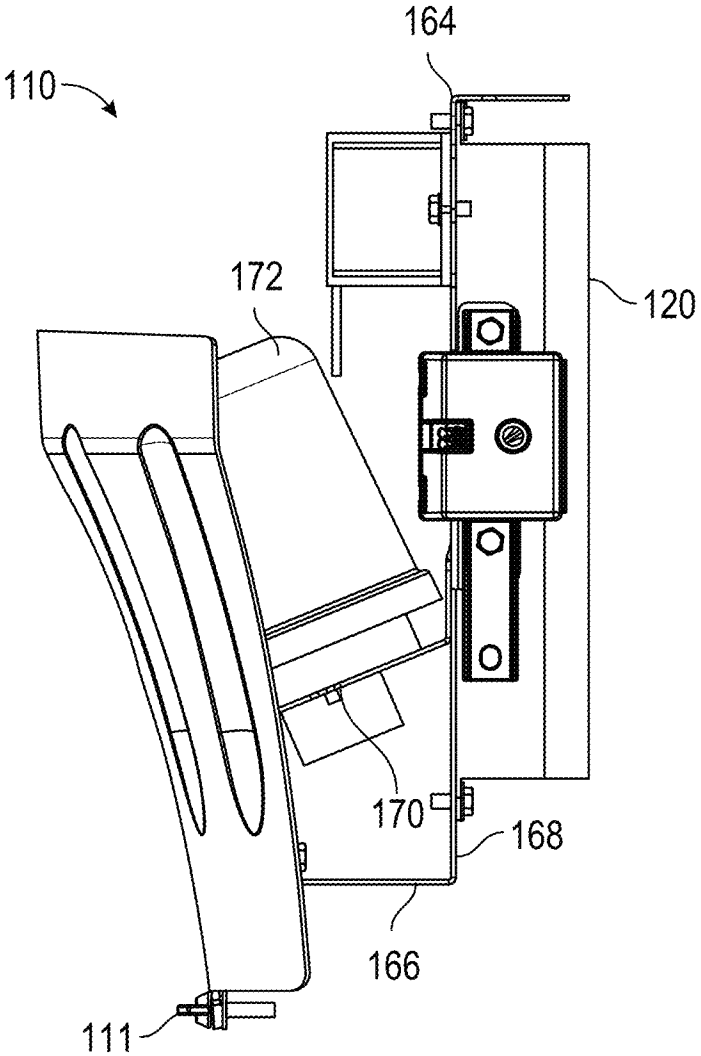
FIG. 10 is a side view of the housing door of FIG. 9.

In some cases, the module 176 and antenna 178 are positioned at the same location on the luminaire 100. For example, FIGS. 8-10 illustrate an example with a wireless node 172 having a module 176 with an onboard antenna 178, and the wireless node 172 is positioned on the electrical tray 164 and within the housing chamber 118.

Figure 11:
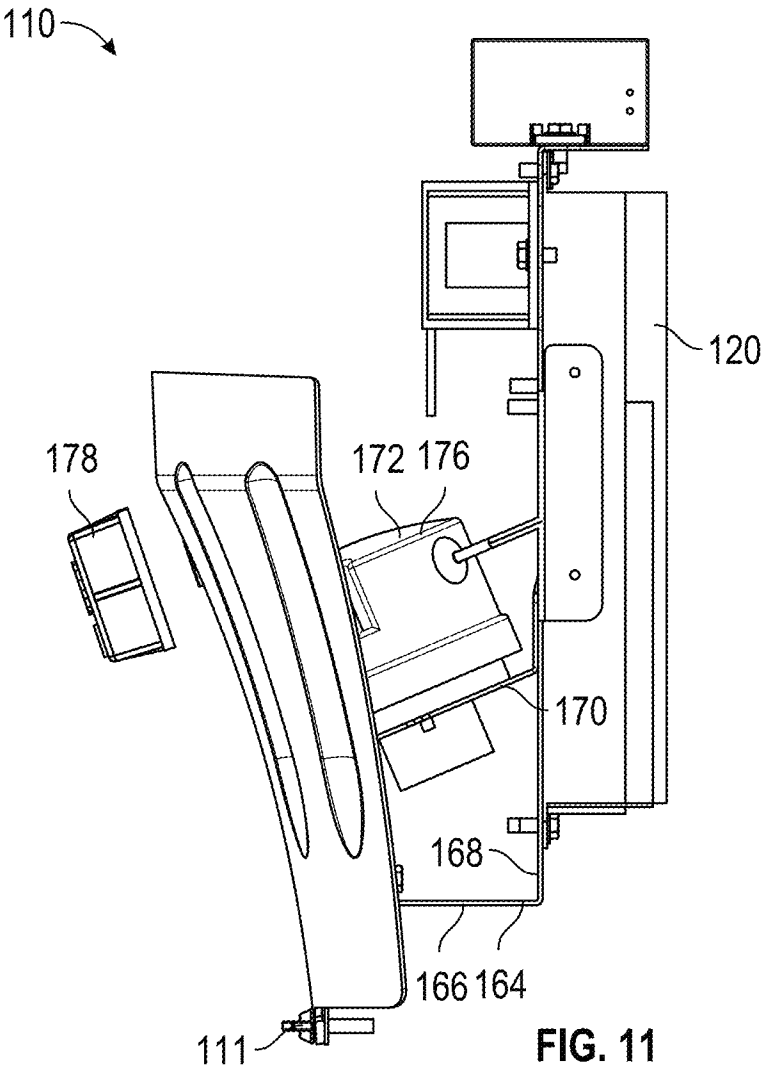
FIG. 11 is a side view of another housing door of a housing assembly according to aspects of the current disclosure.

In other examples, the module 176 and antenna 178 are positioned at different locations on the luminaire 100. For example, FIG. 11 illustrates an example with a wireless node 172 where the module 176 is positioned on the electrical tray 164 and within the housing chamber 118 and the antenna 178 is positionable on the opposing surface of the housing door 110 outside of the housing chamber 118. As further non-limiting examples, the module 176 may be positioned within the housing chamber 118 and the antenna 178 may be positioned on any one of the spacer 104, stalk 138, on the globe 106 (within the globe chamber or outside of the globe chamber), etc. In examples where the antenna 178 is positioned on components that may interfere with signals from the antenna 178 (e.g., the spacer 104, stalk 138, etc.), windows or apertures similar to the window 174 may be provided in such components. For example, if the antenna 178 is positioned on the spacer 104, one or more windows may be provided on the spacer 104 to improve line of sight and signal strength. In some non-limiting examples, placing at least the antenna 178 within the globe chamber may allow for better line of sight for control, signal strength, and maintenance.

In various other examples, the module 176 and/or the antenna 178 may be positioned external to the housing assembly 102 and the globe 106 of the luminaire 100. As one non-limiting example, the antenna 178 may be positioned in a nonmetallic pole on which the luminaire 100 is supported. In this example, the module 176 may be positioned on the luminaire 100 or on the pole. In other examples, the module 176 and/or the antenna 178 may be positioned at various other locations external to the luminaire 100.

Spacer with Thermal Management

Figure 12:
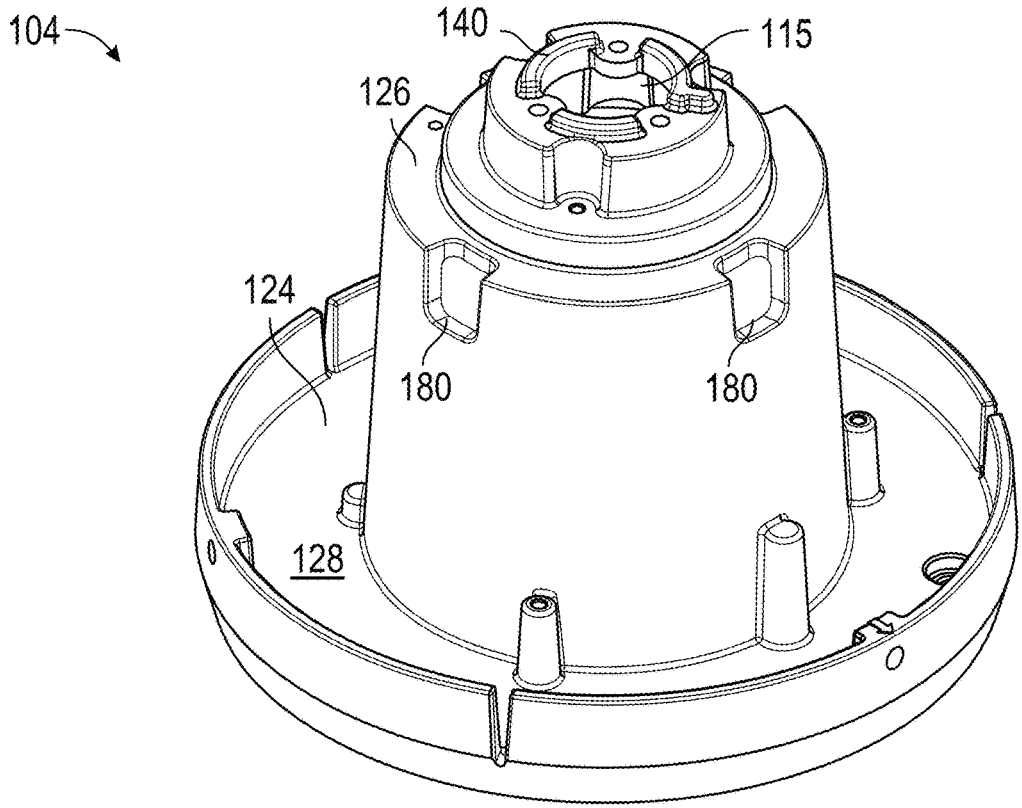
FIG. 12 is a perspective view of the spacer of FIG. 1.

As best illustrated in FIG. 12, in various examples, the spacer 104 defines one or more airflow apertures 180 to facilitate airflow. The airflow apertures 180 are in fluid communication with the central passageway 115 such that air can pass through the spacer 104 and improve thermal management, as discussed below. In some examples, the airflow apertures 180 are provided between the spacer rim 124 and an end of the spacer body 126 that is opposite from the spacer rim 124, although they need not be in other examples. The size, shape, position, and number of airflow apertures 180 should not be considered limiting on the current disclosure. For example, FIG. 19 illustrates an example of a spacer 1904 with elongated airflow apertures 180 compared to the airflow apertures 180 of the spacer 104 of FIGS. 1-18.

Figure 20:
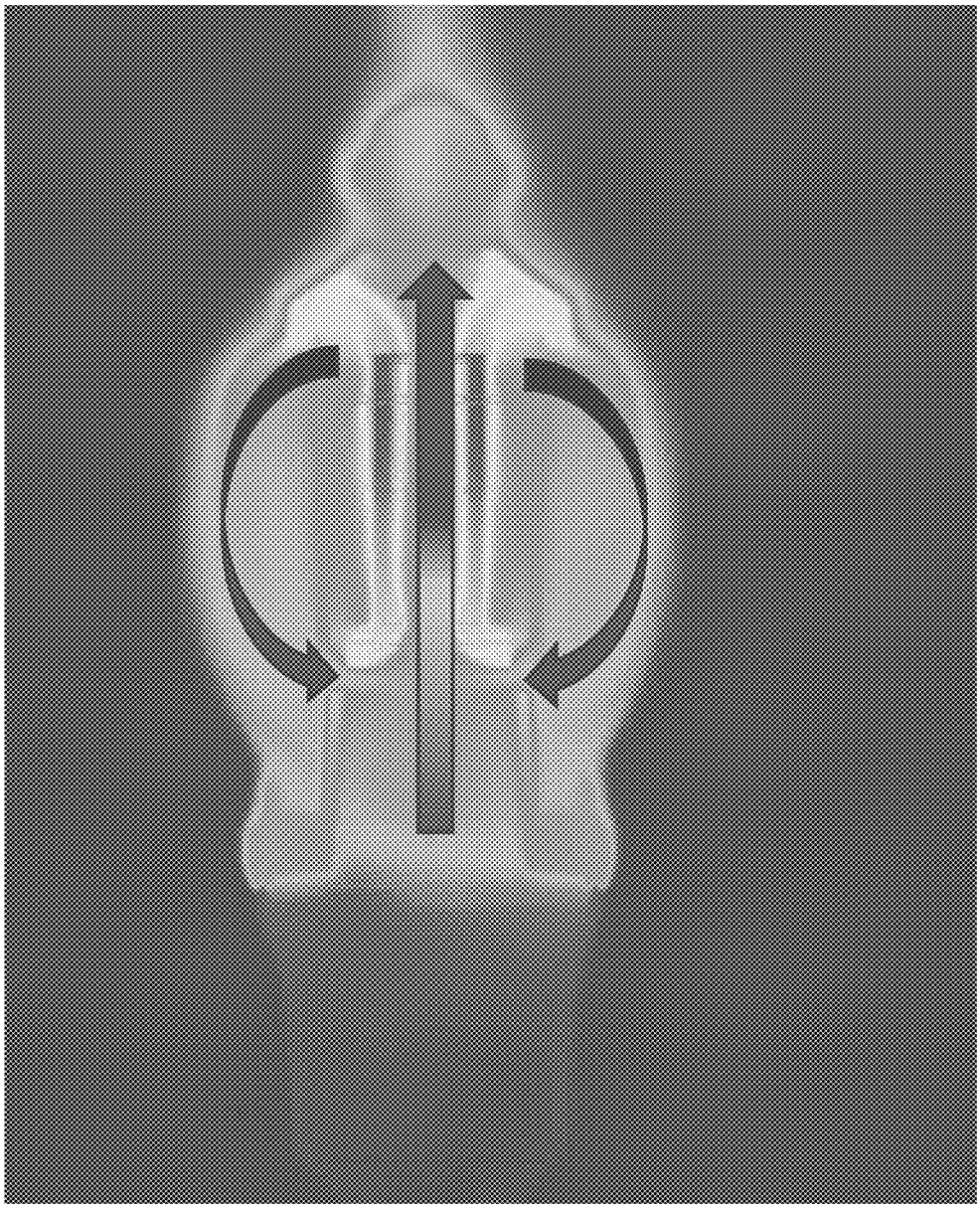
FIG. 20 is a computational fluid dynamics ("CFD") model showing temperature gradients and air flow within the luminaire of FIG. 1 according to certain aspects of the present disclosure.
Figure 21:
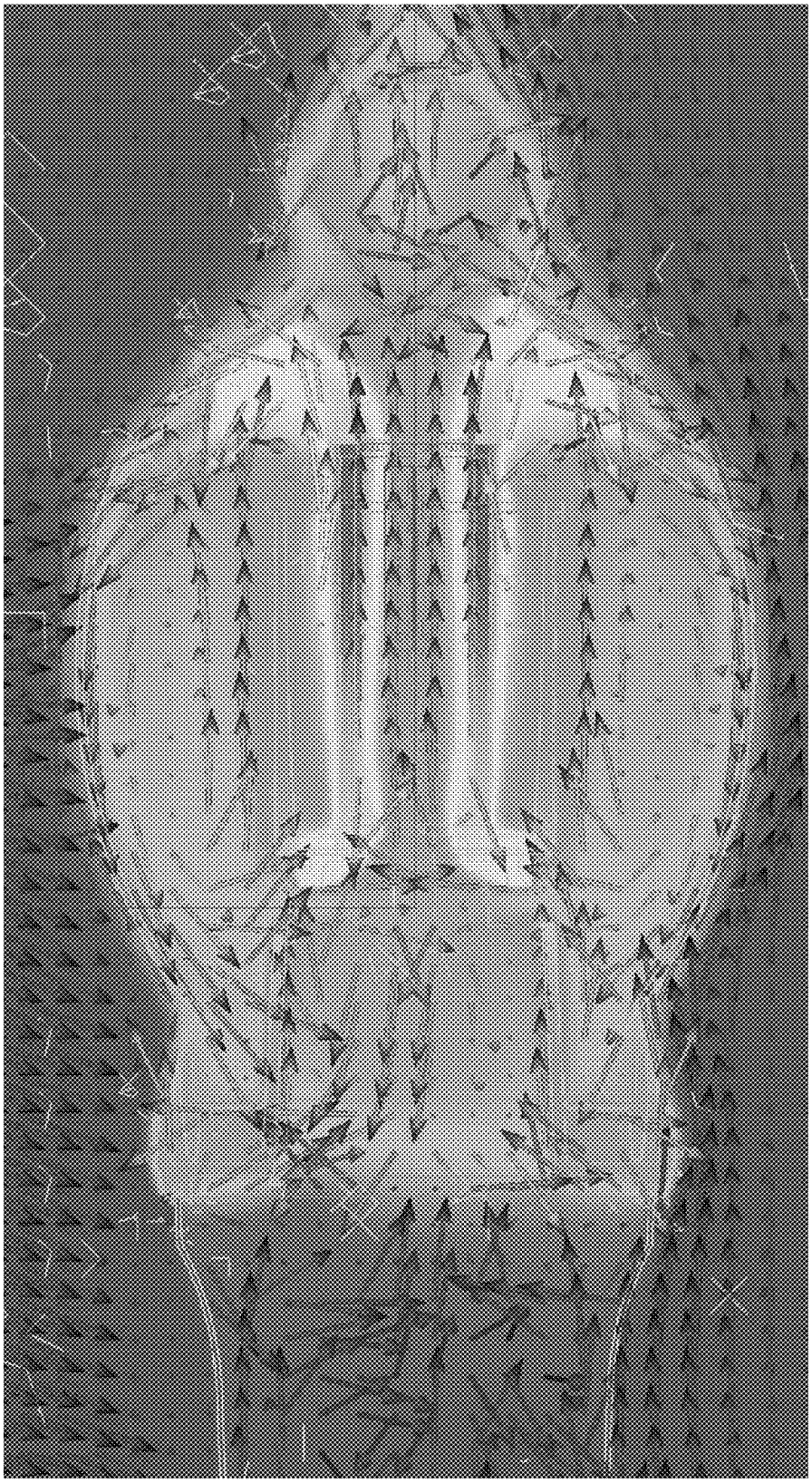
FIG. 21 is another CFD model showing temperature gradients and air flow within the luminaire of FIG. 1 according to certain aspects of the present disclosure.

As mentioned, when the globe 106 is positioned on the spacer 104, the luminaire 100 becomes fully enclosed. When the luminaire 100 is used, heat generated by the electronic components and the LEDs dissipates to the air in the luminaire 100 (e.g., within the globe chamber and/or the housing chamber 118). The air can rise up from the housing 108, through the central passageways of the spacer 104 and the stalk 138, and exit the top of the stalk 138. The air then moves along a downward path along the outside of the stalk 138 and the spacer 104, carrying heat with it as it goes. The air enters the airflow apertures 180 of the spacer 104 to gain entry back into the spacer 104 and the stalk 138 and moves upwardly again, both inside and along the outside of the stalk 138 and the spacer 104. In this way, the central passageways of the spacer 104 and the stalk 138 through the middle of the luminaire 100 act as a flue that allows air to continuously circulate through the luminaire (through the airflow apertures 180) and thereby dissipate heat. FIGS. 20 and 21 show exemplary air flow within the luminaire.

Collar

Figure 1:
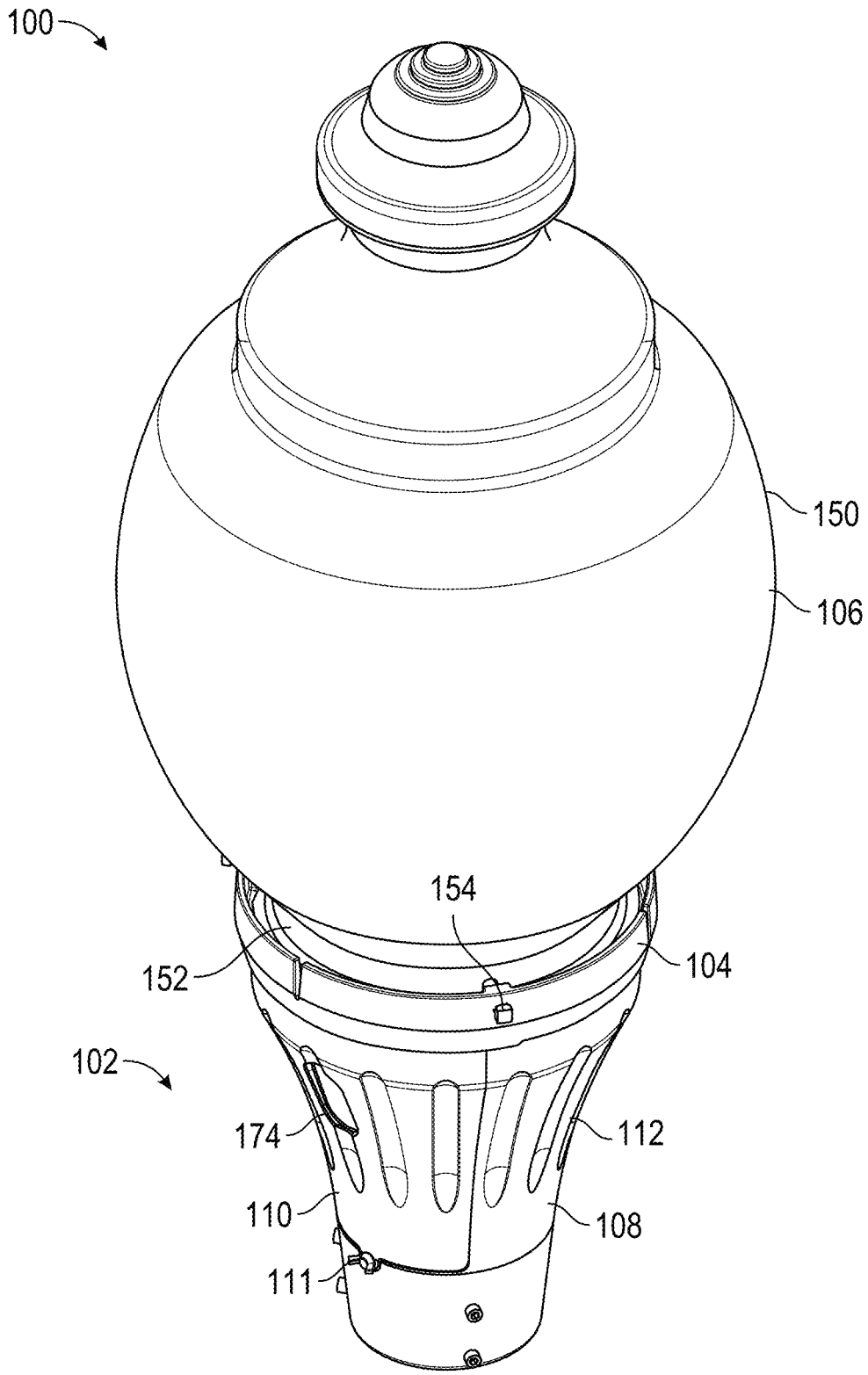
FIG. 1 is a perspective view of a luminaire including a housing assembly, a spacer, and a globe optic according to aspects of the current disclosure.
Figure 2:
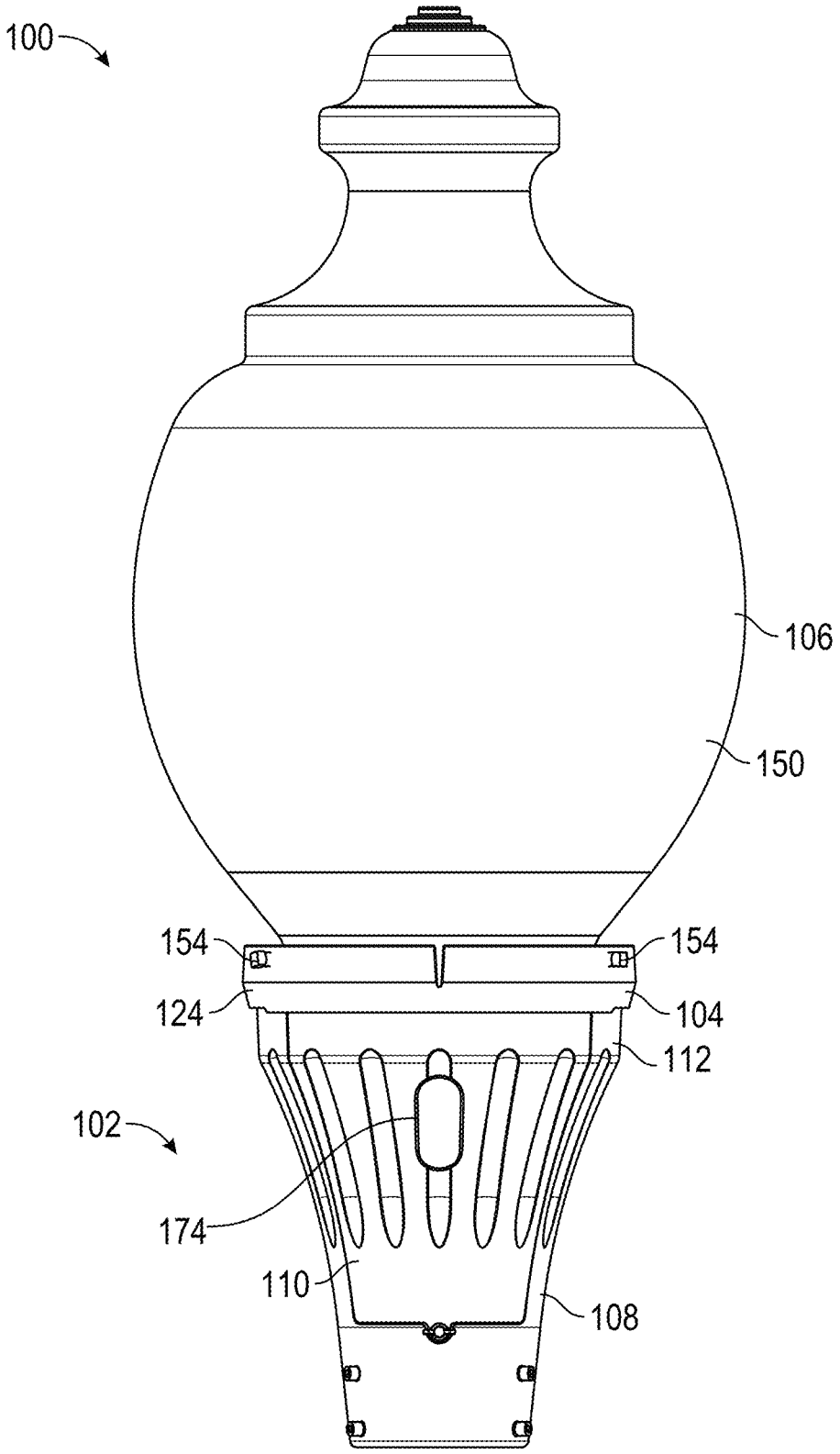
FIG. 2 is a front view of the luminaire of FIG. 1.
Figure 3:
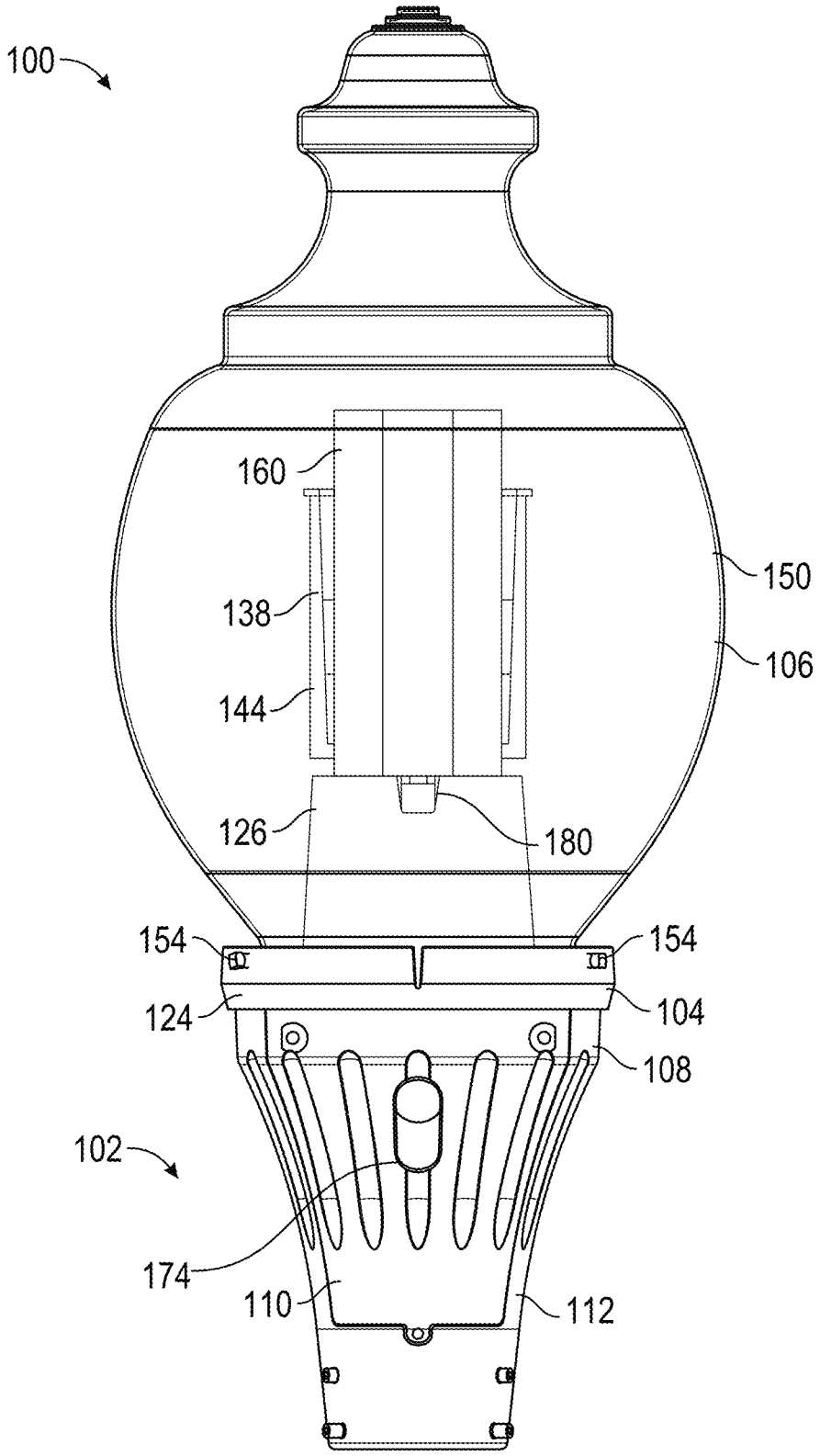
FIG. 3 is another front view of the luminaire of FIG. 1 with the globe optic illustrated as transparent and further illustrating a light engine stalk and a reflector shield.
Figure 4:
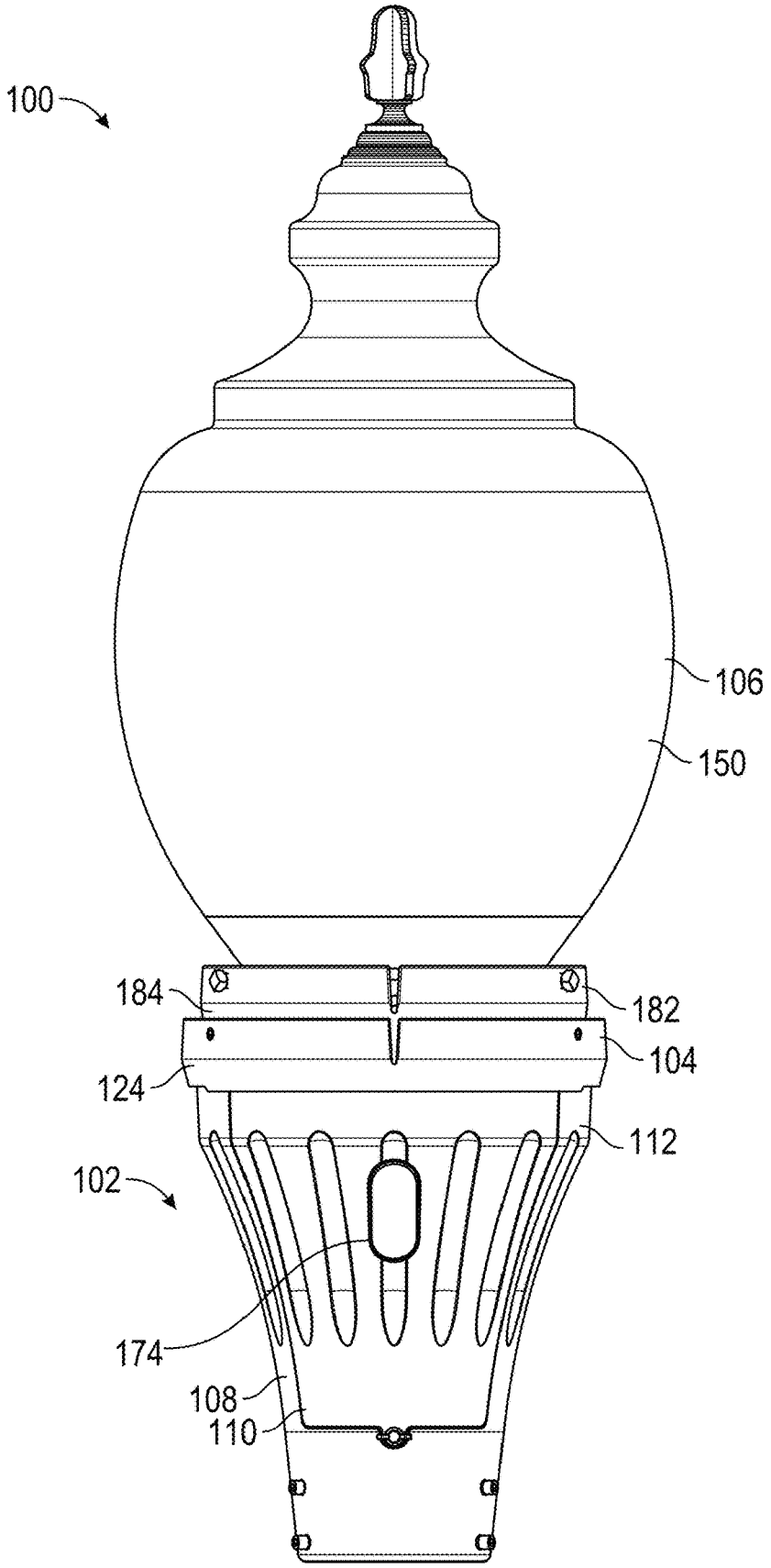
FIG. 4 is a front view of the luminaire of FIG. 1 with a collar between the spacer and the globe optic.
Figure 5:
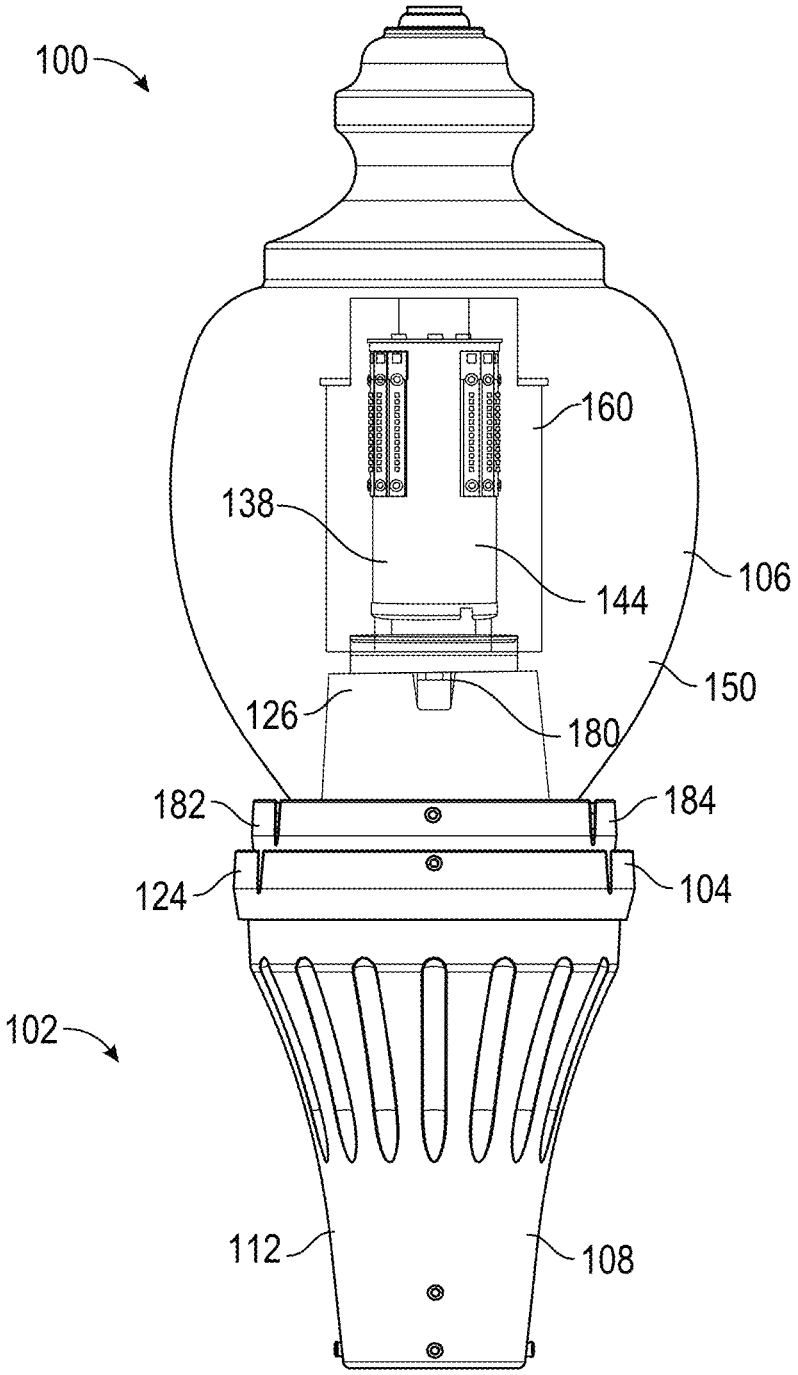
FIG. 5 is a rear view of the luminaire of FIG. 4 with the globe optic illustrated as transparent.
Figure 6:
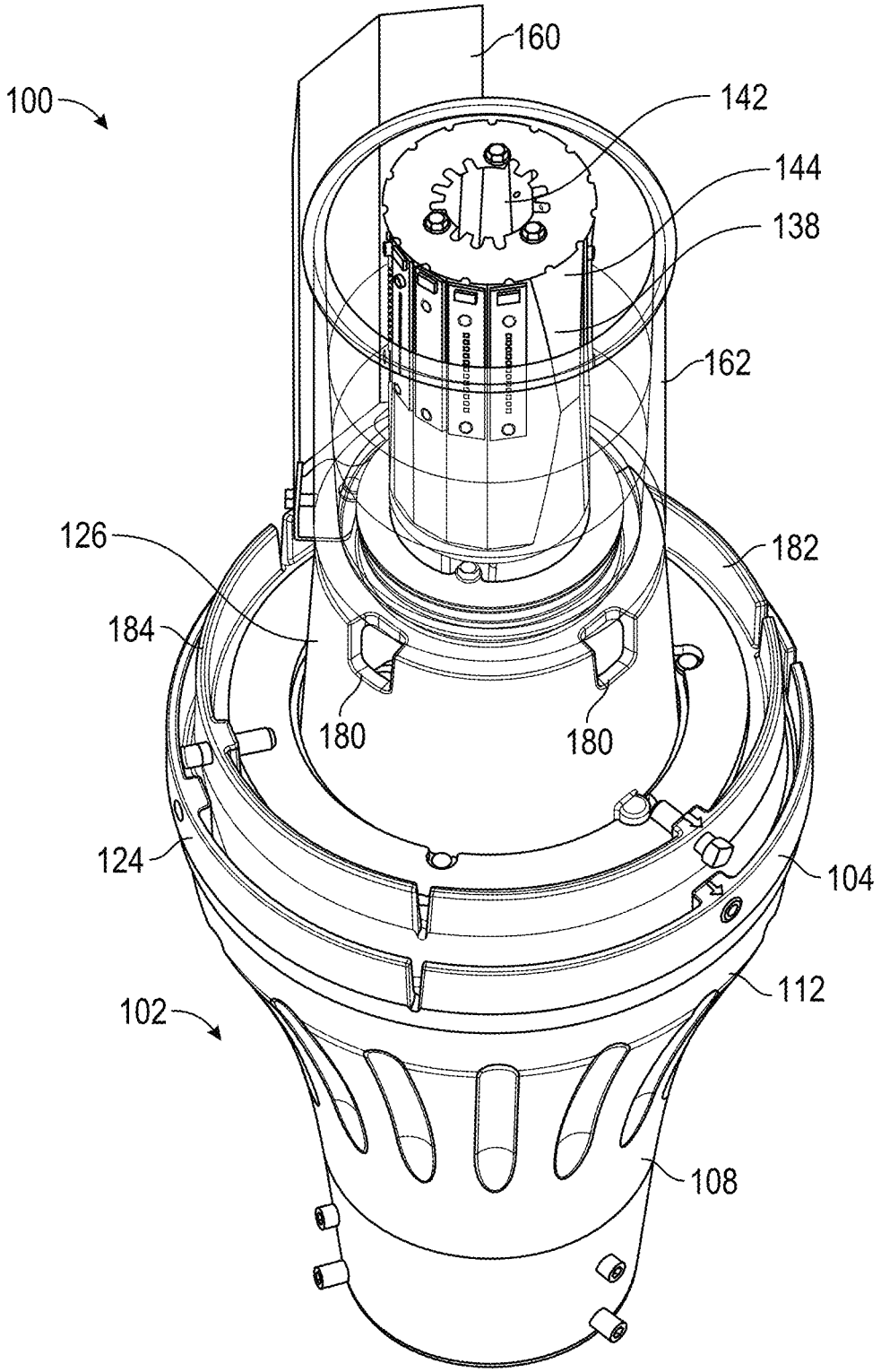
FIG. 6 is a perspective view of the luminaire of FIG. 4 with the globe optic removed and further including a light engine stalk, an internal refractor, and a reflector shield.
Figure 7:
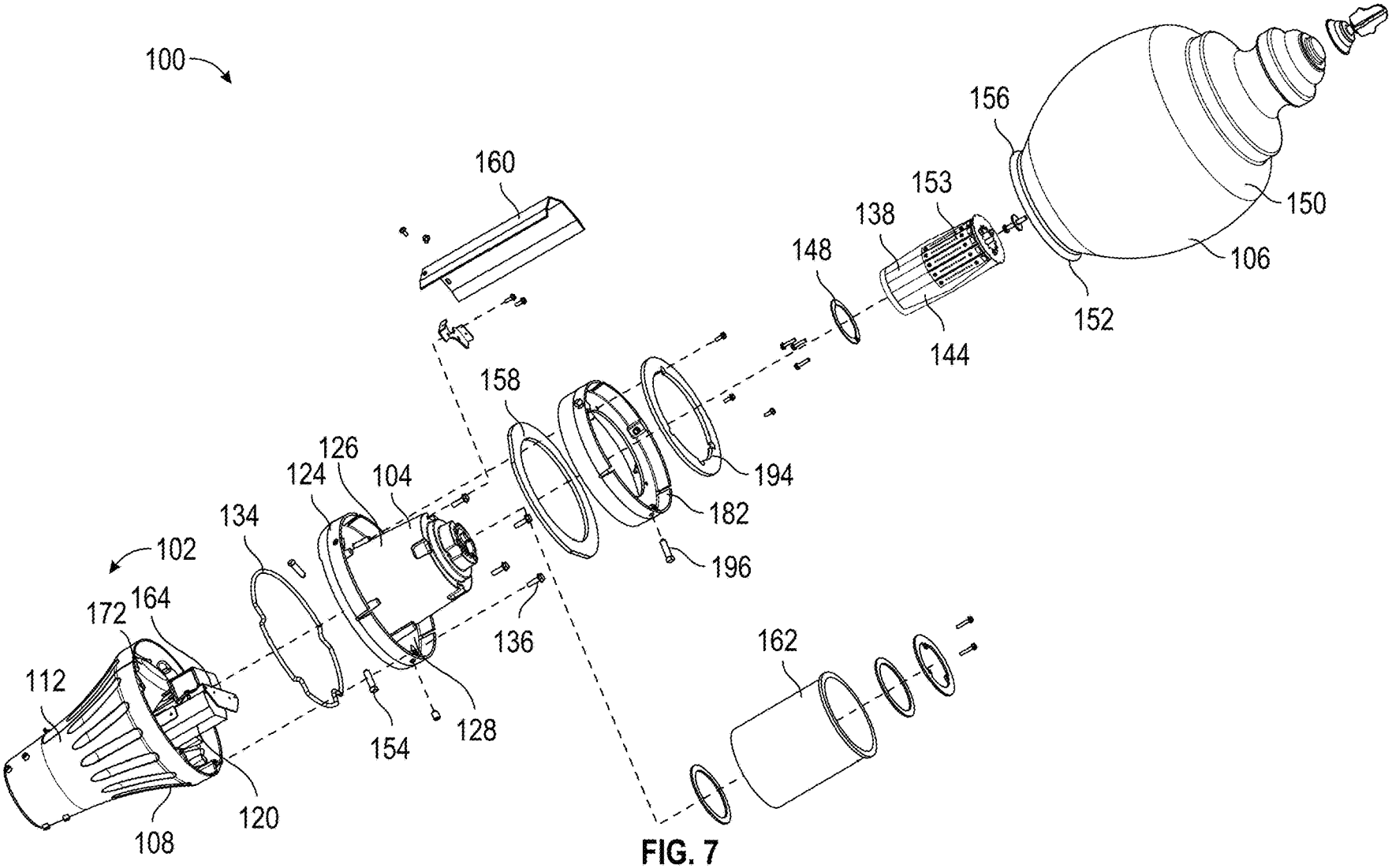
FIG. 7 is an exploded assembly view of the luminaire of FIG. 5.

In some embodiments, a particular-sized globe 106 may be desirable but that size is incompatible with the spacer 104. More specifically, in some embodiments the base 152 of the desired globe 106 may be too small to be securely retained on the spacer 104 and may result in inadequate sealing of the luminaire 100. In the past, use of the smaller globe 106 would have required that the entire luminaire 100 be replaced. However, in embodiments of the present invention, a collar 182 is used to adapt the existing spacer 104 to a smaller-sized globe 106. FIGS. 1-3 illustrate an embodiment of a luminaire 100 without a collar 182; FIGS. 4-6 illustrate an embodiment of a luminaire 100 with a collar 182.

Figure 17:
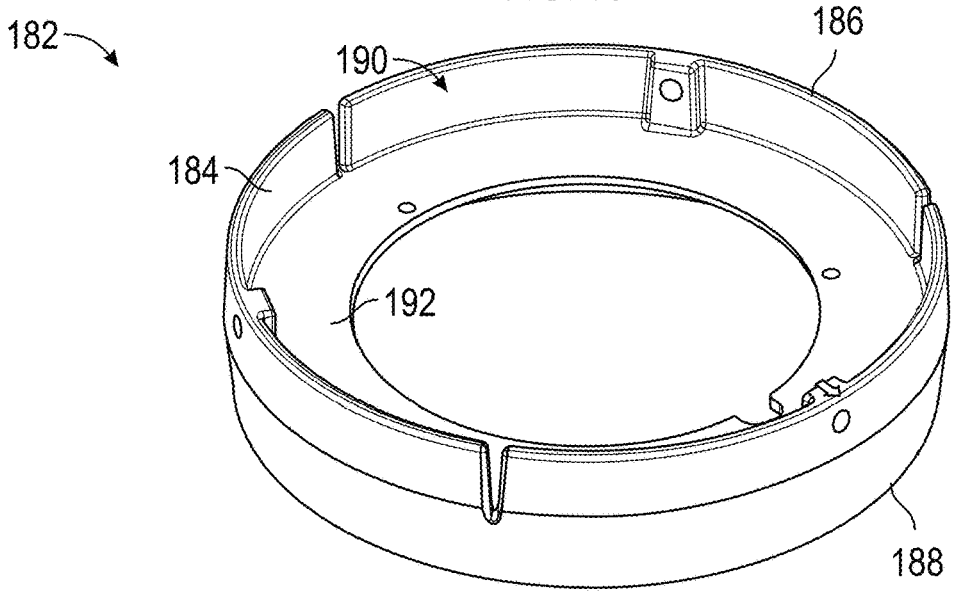
FIG. 17 is a perspective view of the collar of FIG. 4.
Figure 18:
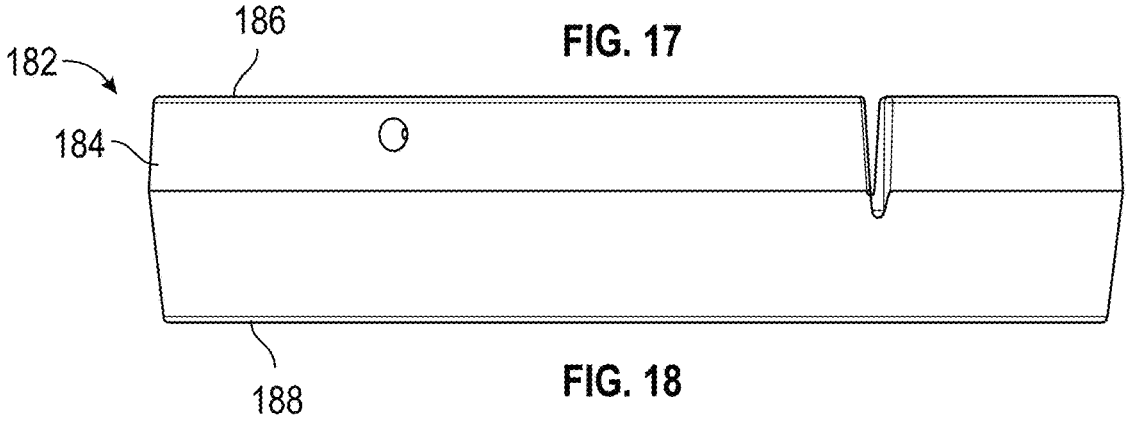
FIG. 18 is a side view of the collar of FIG. 17.
Figure 19:
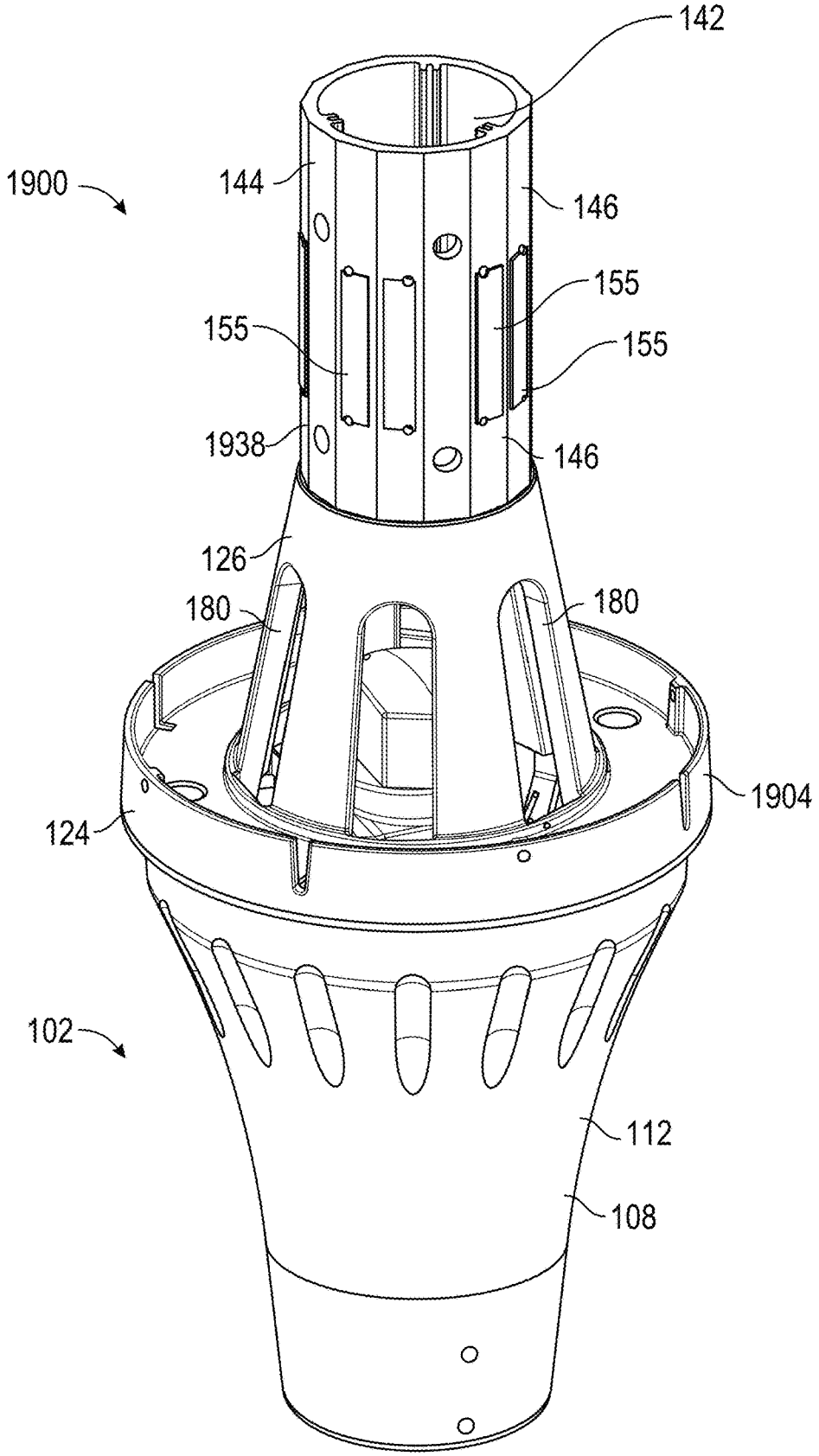
FIG. 19 is a perspective view of a housing assembly, a spacer, and a light engine stalk of a luminaire according to aspects of the current disclosure.

As best illustrated in FIGS. 17 and 18, the collar 182 includes a sidewall 184 having a first end 186 and a second end 188. The sidewall 184 defines a central opening 190 extending through the collar 182 from the first end 186 to the second end 188. The collar 182 includes a ledge 192 within the central opening 190. In various examples, the ledge 192 is positioned between the first end 186 and the second end 188, although it need not in other examples. The collar 182 includes an outer diameter that is smaller than the diameter of the spacer rim 124. In some optional examples, a diameter of the collar 182 at the first end 186 is different from a diameter of the collar 182 at the second end 188. As one non-limiting example and as illustrated in FIG. 18, in some cases, the diameter of the collar 182 at the first end 186 is greater than the diameter of the collar 182 at the second end 188. In other examples, the collar 182 need not have different diameters at the first end 186 and the second end 188.

In various aspects, the diameter of the collar 182 is smaller than the diameter of the spacer rim 124 such that the collar 182 can be seated within the spacer rim 124 and on the rim surface 128. The screws 154 or other suitable retaining mechanisms may position and retain the collar 182 on the spacer 104. The smaller globe 106 may then be positioned on the ledge 192 of the collar 182 and retained on the collar 182 with one or more screws 196 (or other suitable retaining mechanisms). The screws 196 may extend through the collar 182 and bear against the top of the flange 156, drawing the base 152 of the globe 106 against the collar 182.

The collar may be formed from the same or similar material as any one of the housing assembly 102, the spacer 104, or the light engine stalk 138. In some examples, the gasket 158 may optionally be positioned between the spacer 104 and the collar 182, and another gasket 194 may be interposed between the collar 182 and the globe 106 when the luminaire is assembled.

A collection of exemplary embodiments, including at least some explicitly enumerated as "ECs" (Example Combinations), providing additional description of a variety of embodiment types in accordance with the concepts described herein are provided below. These examples are not meant to be mutually exclusive, exhaustive, or restrictive; and the invention is not limited to these example embodiments but rather encompasses all possible modifications and variations within the scope of the issued claims and their equivalents.

EC 1. A luminaire comprising: a housing comprising a first end and a second end opposite from the first end; a spacer positioned on the first end of the housing and comprising a spacer rim, wherein the spacer rim comprises a first transverse dimension; and a collar positioned on the spacer rim, wherein the collar comprises a second transverse dimension that is less than the first transverse dimension of the spacer rim.

EC 2. The luminaire of any of the preceding or subsequent example combinations, wherein the collar comprises a sidewall defining an opening through the collar and a ledge extending from the sidewall into the opening, and wherein the ledge is adapted to receive a globe of the luminaire.

EC 3. The luminaire of any of the preceding or subsequent example combinations, further comprising the globe, wherein the globe comprises a light-emitting portion defining a globe chamber and a base defining an opening to the globe chamber, wherein the base of the globe is seated on the ledge of the collar, and wherein the globe seated on the collar seals the luminaire.

EC 4. The luminaire of any of the preceding or subsequent example combinations, wherein the collar comprises a sidewall defining an opening through the collar, wherein the sidewall comprises a first end having a third transverse dimension and a second end opposite from the first end and having the second transverse dimension, and wherein the third transverse dimension is less than the second transverse dimension.

EC 5. The luminaire of any of the preceding or subsequent example combinations, wherein the collar comprises a sidewall defining an opening through the collar and a ledge extending from the sidewall into the opening, and wherein the luminaire further comprises at least one of a gasket between the collar and the spacer or a gasket on the ledge of the collar.

EC 6. The luminaire of any of the preceding or subsequent example combinations, wherein the spacer further comprises a spacer body, wherein the spacer body extends upwardly relative to the spacer rim, and wherein the luminaire further comprises: a light engine stalk positioned on an end of the spacer body that is opposite from the spacer rim; and at least one light emitting diode mounted on an outer surface of the light engine stalk.

EC 7. A collar for a luminaire, the collar comprising: a sidewall defining an opening through the collar and comprising a first end and a second end opposite from the first end; and a ledge extending from the sidewall and into the opening, wherein the ledge is positioned between the first end and the second end, and wherein the ledge comprises a first surface proximate to the first end and a second surface proximate to the second end, wherein a transverse dimension of the first end of the sidewall is less than a transverse dimension of the second end of the sidewall, and wherein the collar is configured to seat a base of a globe of the luminaire on the second surface of the ledge when assembled.

EC 8. The collar of any of the preceding or subsequent example combinations, further comprising a gasket on the second surface of the ledge.

EC 9. The collar of any of the preceding or subsequent example combinations, further comprising a gasket on the first end of the sidewall.

EC 10. The collar of any of the preceding or subsequent example combinations, wherein the sidewall between the ledge and the second end comprises a plurality of retaining mechanisms that are configured to retain the globe on the ledge.

EC 11. The collar of any of the preceding or subsequent example combinations, wherein the collar comprises a thermally conductive material.

EC 12. A luminaire comprising: a spacer comprising a spacer rim and a spacer body, wherein the spacer rim comprises a rim surface, wherein the spacer rim comprises a first transverse dimension, and wherein the spacer body extends upwardly relative to the rim surface; and a collar comprising a sidewall defining an opening through the collar and a ledge extending from the sidewall into the opening, wherein the sidewall comprises a second transverse dimension that is less than the first transverse dimension of the spacer rim, and wherein the collar is positionable on the rim surface such that the spacer body extends through the opening of the collar.

EC 13. The luminaire of any of the preceding or subsequent example combinations, further comprising a housing comprising a first end and a second end opposite from the first end, wherein the housing defines a housing chamber, and wherein the spacer is positioned on the first end of the housing.

EC 14. The luminaire of any of the preceding or subsequent example combinations, wherein the spacer rim further comprises a mounting surface opposite from the rim surface, wherein the mounting surface comprises a gasket groove, and wherein the luminaire further comprises a gasket within the gasket groove and between the first end of the housing and the spacer.

EC 15. The luminaire of any of the preceding or subsequent example combinations, further comprising: a globe positioned on the collar and defining a globe chamber; and a wireless node comprising: a wireless module; and an antenna associated with the wireless module, wherein the wireless module is positioned within the housing chamber, and wherein the antenna is positioned on at least one of the housing within the housing chamber, the globe within the globe chamber, or the globe outside of the globe chamber.

EC 16. The luminaire of any of the preceding or subsequent example combinations, further comprising a globe, wherein the globe comprises a light-emitting portion defining a globe chamber and a base defining an opening to the globe chamber, and wherein the base of the globe is seated on the ledge of the collar.

EC 17. The luminaire of any of the preceding or subsequent example combinations, further comprising: a light engine stalk positioned on an end of the spacer body that is opposite from the spacer rim; and at least one light emitting diode (LED) mounted on an outer surface of the light engine stalk, wherein the light engine stalk and the at least one LED are positioned within the globe chamber.

EC 18. The luminaire of any of the preceding or subsequent example combinations, further comprising a gasket between the ledge of the collar and the globe.

EC 19. The luminaire of any of the preceding or subsequent example combinations, further comprising a gasket between the spacer and the collar, wherein the spacer body defines a central passageway extending through the spacer body such that the spacer is hollow along a length of the spacer.

EC 20. The luminaire of any of the preceding or subsequent example combinations, wherein the spacer body defines a plurality of airflow apertures in fluid communication with the central passageway, wherein the airflow apertures are configured to circulate air through the spacer.

EC 21. A luminaire comprising: a housing comprising a first end and a second end opposite from the first end, wherein the housing defines a housing chamber; a globe positioned relative to the first end of the housing and defining a globe chamber; and a wireless node comprising a wireless module and an antenna associated with the wireless module, wherein at least the wireless module is positioned within the housing chamber.

EC 22. The luminaire of any of the preceding or subsequent example combinations, wherein the antenna is positioned within the globe chamber.

EC 23. The luminaire of any of the preceding or subsequent example combinations, wherein the antenna is positioned within the housing chamber.

EC 24. The luminaire of any of the preceding or subsequent example combinations, wherein the antenna is positioned on the globe outside of the globe chamber.

EC 25. The luminaire of any of the preceding or subsequent example combinations, wherein the housing comprises a sidewall, wherein the sidewall comprises the first end and the second end of the housing and defines the housing chamber, wherein the sidewall defines an opening extending through the sidewall, wherein the housing comprises a housing door that is positionable within the opening in the sidewall, wherein the housing door comprises a window, and wherein the window comprises a non-round profile.

EC 26. The luminaire of any of the preceding or subsequent example combinations, wherein the housing door comprises an electrical tray, and wherein the wireless module is mounted on the electrical tray.

EC 27. The luminaire of any of the preceding or subsequent example combinations, further comprising: a spacer positioned on the first end of the housing between the housing and the globe, wherein the spacer comprises a spacer rim and a spacer body, wherein the spacer body extends upwardly relative to the spacer rim, wherein the globe is positioned on the spacer rim, wherein the spacer body defines a central passageway extending through the spacer body such that the spacer is hollow along a length of the spacer, and wherein the antenna is positioned within the central passageway of the spacer.

EC 28. A luminaire comprising: a housing comprising a sidewall comprising first end and a second end opposite from the first end, wherein the sidewall defines a housing chamber, wherein the sidewall defines an opening extending through the sidewall, wherein the housing comprises a housing door that is positionable within the opening in the sidewall, and wherein the housing door comprises a window; and a wireless node comprising a wireless module and an antenna associated with the wireless module, wherein the wireless node is positioned within the housing chamber.

EC 29. The luminaire of any of the preceding or subsequent example combinations, wherein the housing door comprises an electrical tray, and wherein the wireless module is mounted on the electrical tray.

EC 30. The luminaire of any of the preceding or subsequent example combinations, wherein the antenna is mounted on the electrical tray.

EC 31. The luminaire of any of the preceding or subsequent example combinations, wherein the electrical tray comprises: an extension arm extending from an inner surface of the housing door; and a mounting arm extending upwardly at an angle from the extension arm.

EC 32. The luminaire of any of the preceding or subsequent example combinations, wherein the angle is greater than 90 degrees.

EC 33. The luminaire of any of the preceding or subsequent example combinations, wherein the electrical tray further comprises a support ledge extending from the mounting arm, and wherein the wireless module is supported on the support ledge.

EC 34. The luminaire of any of the preceding or subsequent example combinations, wherein the wireless module comprises at least one of a radio frequency module, a radar module, a lidar module, a microwave sensor module, or a Bluetooth module EC 35. A luminaire comprising: a housing comprising a first end and a second end opposite from the first end, wherein the housing defines a housing chamber; a globe positioned relative to the first end of the housing and defining a globe chamber; and a wireless node comprising a wireless module and an antenna associated with the wireless module, wherein at least the antenna is positioned within the globe chamber.

EC 36. The luminaire of any of the preceding or subsequent example combinations, wherein the antenna is positioned on the globe.

EC 37. The luminaire of any of the preceding or subsequent example combinations, further comprising: a spacer positioned on the first end of the housing between the housing and the globe, wherein the spacer comprises a spacer rim and a spacer body, wherein the spacer body extends upwardly relative to the spacer rim, wherein the globe is positioned on the spacer rim, wherein the spacer body defines a central passageway extending through the spacer body such that the spacer is hollow along a length of the spacer, and wherein the antenna is positioned within the central passageway of the spacer.

EC 38. The luminaire of any of the preceding or subsequent example combinations, wherein the wireless module is positioned within the housing chamber.

EC 39. The luminaire of any of the preceding or subsequent example combinations, wherein the housing comprises a sidewall, wherein the sidewall comprises the first end and the second end of the housing and defines the housing chamber, wherein the sidewall defines an opening extending through the sidewall, wherein the housing comprises a housing door that is positionable within the opening in the sidewall, and wherein the housing door comprises a window.

EC 40. The luminaire of any of the preceding or subsequent example combinations, wherein the housing door comprises an electrical tray, and wherein the wireless module is mounted on the electrical tray.

EC 41. A luminaire comprising: a housing comprising a first end and a second end opposite from the first end, wherein the housing defines a housing chamber; and a spacer comprising a spacer rim and a spacer body, wherein the spacer body extends upwardly relative to the spacer rim, wherein the spacer body defines a central passageway extending through the spacer body such that the spacer is hollow along a length of the spacer, and wherein the spacer body defines a plurality of airflow apertures in fluid communication with the central passageway.

EC 42. The luminaire of any of the preceding or subsequent example combinations, wherein the spacer body comprises an end opposite from the spacer rim, and wherein the luminaire further comprises a light engine stalk mounted on the end of the spacer body, wherein the light engine stalk defines a central passageway in fluid communication with the central passageway and airflow apertures of the spacer.

EC 43. The luminaire of any of the preceding or subsequent example combinations, wherein the light engine stalk comprises an outer surface, and wherein the luminaire further comprises a plurality of light emitting diodes on the outer surface of the light engine stalk.

EC 44. The luminaire of any of the preceding or subsequent example combinations, wherein the spacer body defines the plurality of airflow apertures between the spacer rim and the end of the spacer body.

EC 45. The luminaire of any of the preceding or subsequent example combinations, wherein the spacer body defines the plurality of airflow apertures between the spacer rim and an end of the spacer body opposite from the spacer rim.

EC 46. The luminaire of any of the preceding or subsequent example combinations, further comprising a globe, wherein the globe comprises a light-emitting portion defining a globe chamber and a base defining an opening to the globe chamber, and wherein the base of the globe is seated on the spacer rim such that the spacer body is positioned within the globe chamber.

EC 47. The luminaire of any of the preceding or subsequent example combinations, wherein the housing and the spacer each comprise a thermally conductive material.

EC 48. A spacer for a luminaire, the spacer comprising: a spacer rim comprising a rim surface; and a spacer body extending upwardly relative to the rim surface of the spacer rim, wherein the spacer body defines a central passageway extending through the spacer body such that the spacer is hollow along a length of the spacer, and wherein the spacer body defines at least one airflow aperture that is in fluid communication with the central passageway.

EC 49. The spacer of any of the preceding or subsequent example combinations, wherein a transverse dimension of the spacer rim is greater than a transverse dimension of the spacer body.

EC 50. The spacer of any of the preceding or subsequent example combinations, wherein the spacer body comprises an end that is opposite from the spacer rim, and wherein the at least one airflow aperture is defined between the end and the spacer rim.

EC 51. The spacer of any of the preceding or subsequent example combinations, wherein the at least one airflow aperture comprises a plurality of airflow apertures.

EC 52. The spacer of any of the preceding or subsequent example combinations, wherein the spacer rim further comprises a mounting surface that is opposite from the rim surface, wherein the mounting surface defines a gasket groove, and wherein the spacer further comprises a gasket within the gasket groove.

EC 53. The spacer of any of the preceding or subsequent example combinations, wherein the spacer rim and the spacer body each comprise a metallic material.

EC 54. The spacer of any of the preceding or subsequent example combinations, wherein the spacer rim comprises a plurality of retaining mechanisms that are configured to retain a globe of the luminaire on the rim surface.

EC 55. A luminaire comprising: a spacer comprising a spacer rim and a spacer body, wherein the spacer body extends upwardly relative to the spacer rim and comprises an end opposite from the spacer rim, wherein the spacer body defines a central passageway extending through the spacer body such that the spacer is hollow along a length of the spacer, and wherein the spacer body defines at least one airflow aperture in fluid communication with the central passageway; and a light engine stalk mounted on the end of the spacer body, wherein the light engine stalk defines a central passageway in fluid communication with the central passageway and at least one airflow aperture of the spacer.

EC 56. The luminaire of any of the preceding or subsequent example combinations, further comprising a housing comprising a first end and a second end opposite from the first end, wherein the housing defines a housing chamber, and wherein the spacer is positioned on the first end of the housing.

EC 57. The luminaire of any of the preceding or subsequent example combinations, further comprising a globe, wherein the globe comprises a light-emitting portion defining a globe chamber and a base defining an opening to the globe chamber, and wherein the base of the globe is seated on the spacer rim such that the spacer body and the light engine stalk are positioned within the globe chamber.

EC 58. The luminaire of any of the preceding or subsequent example combinations, wherein the at least one airflow aperture comprises a plurality of airflow apertures.

EC 59. The luminaire of any of the preceding or subsequent example combinations, wherein the light engine stalk comprises an outer surface, and wherein the luminaire further comprises a plurality of light emitting diodes on the outer surface of the light engine stalk.

EC 60. The luminaire of any of the preceding or subsequent example combinations, further comprising: a housing comprising a first end and a second end opposite from the first end, wherein the housing defines a housing chamber, and wherein the spacer is positioned on the first end of the housing; a globe positioned on the spacer rim and defining a globe chamber; and a wireless node comprising: a wireless module; and an antenna associated with the wireless module, wherein the wireless module is positioned within the housing chamber, and wherein the antenna is positioned on at least one of the housing within the housing chamber, the globe within the globe chamber, or the globe outside of the globe chamber.

Different arrangements of the components depicted in the drawings or described above, as well as components and steps not shown or described are possible. Similarly, some features and sub-combinations are useful and may be employed without reference to other features and sub-combinations. Examples of the invention have been described for illustrative and not restrictive purposes, and alternative examples will become apparent to readers of this patent. Accordingly, the present invention is not limited to the examples described above or depicted in the drawings, and various examples and modifications may be made without departing from the scope of the claims below.

That which is claimed:

1. A luminaire comprising:

a housing comprising a first end and a second end opposite from the first end;

a spacer positioned on the first end of the housing and comprising a spacer rim, wherein the spacer rim comprises a first transverse dimension; and a collar positioned on the spacer rim, wherein the collar comprises a second transverse dimension that is less than the first transverse dimension of the spacer rim, wherein the collar comprises a sidewall defining an opening through the collar and a ledge extending from the sidewall into the opening, and wherein the luminaire further comprises at least one of a gasket between the collar and the spacer or a gasket on the ledge of the collar.

2. The luminaire of claim 1, wherein the ledge is adapted to receive a globe of the luminaire.

3. The luminaire of claim 2, further comprising the globe, wherein the globe comprises a light-emitting portion defining a globe chamber and a base defining an opening to the globe chamber, wherein the base of the globe is seated on the ledge of the collar, and wherein the globe seated on the collar seals the luminaire.

4. The luminaire of claim 1, wherein the sidewall comprises a first end having a third transverse dimension and a second end opposite from the first end and having the second transverse dimension, and wherein the third transverse dimension is less than the second transverse dimension.

5. The luminaire of claim 1, wherein the spacer further comprises a spacer body, wherein the spacer body extends upwardly relative to the spacer rim, and wherein the luminaire further comprises:

a light engine stalk positioned on an end of the spacer body that is opposite from the spacer rim; and at least one light emitting diode mounted on an outer surface of the light engine stalk.

6. A collar for a luminaire, the collar comprising:

a sidewall defining an opening through the collar and comprising a first end and a second end opposite from the first end; and a ledge extending from the sidewall and into the opening, wherein the ledge is positioned between the first end and the second end, and wherein the ledge comprises a first surface proximate to the first end and a second surface proximate to the second end, wherein a transverse dimension of the first end of the sidewall is less than a transverse dimension of the second end of the sidewall, and wherein the collar is configured to seat a base of a globe of the luminaire on the second surface of the ledge when assembled.

7. The collar of claim 6, further comprising a gasket on the second surface of the ledge.

8. The collar of claim 6, further comprising a gasket on the first end of the sidewall.

9. The collar of claim 6, wherein the sidewall between the ledge and the second end comprises a plurality of retaining mechanisms that are configured to retain the globe on the ledge.

10. The collar of claim 6, wherein the collar comprises a thermally conductive material.

11. A luminaire comprising:

a spacer comprising a spacer rim and a spacer body, wherein the spacer rim comprises a rim surface, wherein the spacer rim comprises a first transverse dimension, and wherein the spacer body extends upwardly relative to the rim surface;

a collar comprising a sidewall defining an opening through the collar and a ledge extending from the sidewall into the opening, wherein the sidewall comprises a second transverse dimension that is less than the first transverse dimension of the spacer rim, and wherein the collar is positionable on the rim surface such that the spacer body extends through the opening of the collar, and a gasket between the spacer and the collar, wherein the spacer body defines a central passageway extending through the spacer body such that the spacer is hollow along a length of the spacer.

12. The luminaire of claim 11, further comprising a housing comprising a first end and a second end opposite from the first end, wherein the housing defines a housing chamber, and wherein the spacer is positioned on the first end of the housing.

13. The luminaire of claim 12, wherein the spacer rim further comprises a mounting surface opposite from the rim surface, wherein the mounting surface comprises a gasket groove, and wherein the luminaire further comprises a gasket within the gasket groove and between the first end of the housing and the spacer.

14. The luminaire of claim 12, further comprising:

a globe positioned on the collar and defining a globe chamber; and a wireless node comprising:

a wireless module; and an antenna associated with the wireless module, wherein the wireless module is positioned within the housing chamber, and wherein the antenna is positioned on at least one of the housing within the housing chamber, the globe within the globe chamber, or the globe outside of the globe chamber.

15. The luminaire of claim 11, further comprising a globe, wherein the globe comprises a light-emitting portion defining a globe chamber and a base defining an opening to the globe chamber, and wherein the base of the globe is seated on the ledge of the collar.

16. The luminaire of claim 15, further comprising:

a light engine stalk positioned on an end of the spacer body that is opposite from the spacer rim; and at least one light emitting diode (LED) mounted on an outer surface of the light engine stalk, wherein the light engine stalk and the at least one LED are positioned within the globe chamber.

17. The luminaire of claim 15, further comprising a gasket between the ledge of the collar and the globe.

18. The luminaire of claim 11, wherein the spacer body defines a plurality of airflow apertures in fluid communication with the central passageway, wherein the airflow apertures are configured to circulate air through the spacer.

* * * * *